US009732590B2

(12) United States Patent
Lynch

(10) Patent No.: US 9,732,590 B2
(45) Date of Patent: Aug. 15, 2017

(54) DETECTION AND COLLECTION SYSTEM FOR FUGITIVE GASES AND EFFLUENT LIQUIDS LEAKING FROM AROUND DRILLED WELLHEADS

(71) Applicant: FUTURE ENERGY INNOVATIONS PTY LTD, Queensland (AU)

(72) Inventor: Gary Michael Lynch, Queensland (AU)

(73) Assignee: FUTURE ENERGY INNOVATIONS PTY LTD, Queensland (AU)

( * ) Notice: Subject to any disclaimer, the term of this patent is extended or adjusted under 35 U.S.C. 154(b) by 0 days.

(21) Appl. No.: 14/783,769

(22) PCT Filed: Apr. 11, 2014

(86) PCT No.: PCT/AU2014/000398
§ 371 (c)(1),
(2) Date: Oct. 9, 2015

(87) PCT Pub. No.: WO2014/165921
PCT Pub. Date: Oct. 16, 2014

(65) Prior Publication Data

US 2016/0069162 A1 Mar. 10, 2016

(30) Foreign Application Priority Data

Apr. 12, 2013 (AU) ..... 2013901265

(51) Int. Cl.
*E21B 41/00* (2006.01)
*E21B 33/03* (2006.01)
(Continued)

(52) U.S. Cl.
CPC ..... *E21B 41/00* (2013.01); *E21B 21/015* (2013.01); *E21B 33/03* (2013.01); *E21B 43/0122* (2013.01); *E21B 47/10* (2013.01)

(58) Field of Classification Search
CPC ..... E02B 11/005
(Continued)

(56) References Cited

U.S. PATENT DOCUMENTS 5,573,349 A * 11/1996 Paoluccio ..... E03F 5/16 210/170.03
6,095,718 A * 8/2000 Bohnhoff ..... E02B 11/00 405/36
(Continued)

OTHER PUBLICATIONS

International Search Report and Written Opinion from PCT/AU2014/000398 dated Jun. 24, 2014.

*Primary Examiner* — Sean Andrish
(74) *Attorney, Agent, or Firm* — Studebaker & Brackett PC

(57) ABSTRACT

This invention relates in general to the detection and containment of leaking gas and fluids from around wellheads of a well site. The system comprising: at least one perforated or slotted pipe adapted to be placed adjacent a wellhead and having holes sized to allow the transmission of liquid and gas into the pipe, wherein the liquid or gas are leaking from and around the wellhead conductive pipe and the wellhead; a flexible cover, covering at least the adjacent areas around the wellhead and the at least one perforated or slotted pipe; and a fluid detector in fluid communication with the at least one perforated or slotted pipe.

23 Claims, 15 Drawing Sheets

(51) Int. Cl.
*E21B 47/10* (2012.01)
*E21B 43/01* (2006.01)
*E21B 21/015* (2006.01)

(58) Field of Classification Search
USPC ..... 405/52–55
See application file for complete search history.

(56) References Cited

U.S. PATENT DOCUMENTS

| | | | | |
|---|---|---|---|---|
| 2005/0158123 | A1* | 7/2005 | Ianniello | E01C 3/00 405/129.95 |
| 2012/0219746 | A1 | 8/2012 | Powell | |
| 2013/0089376 | A1 | 4/2013 | Nolt | |

* cited by examiner

DETECTION AND COLLECTION SYSTEM FOR FUGITIVE GASES AND EFFLUENT LIQUIDS LEAKING FROM AROUND DRILLED WELLHEADS

FIELD OF THE INVENTION

This invention relates in general to the detection and containment of leaking gas and fluids from around wellheads. In particular, the present invention relates to the detection and containment of leaking gas and fluids from wellheads used in production and non-production wellheads or from fractured ground faults around wellheads used in oil and gas producing wells.

BACKGROUND OF THE INVENTION

It should be noted that reference to the prior art herein is not to be taken as an acknowledgement that such prior art constitutes common general knowledge in the art.

Leaking wellhead gas and wellhead fluids are a major environmental problem in gas and oil fields with consequent great concerns now held for the carbon foot print created by each wellhead and the potential health risks to workers and local residents.

Often gases and fluids spill from the wellhead. Early containment practice of such spills consisted of digging a pit around the wellhead. Environmental and regulatory concerns effectively discouraged such practice, leading to the need for alternate means to contain gas and liquid spilled from the wellhead. To date, devices and methods used to contain excess gas and fluid spilled from a wellhead have suffered from several drawbacks. For example, such devices and methods generally obstruct the area around the wellhead thereby interfering with servicing and may include pans that require assembly at the well site or are cumbersome to install. Also, where pumping means are used to transfer contained gases or liquids away from the wellhead, such means involve electrical or internal combustion drives which, for safety reasons, must be located some distance away from the wellhead.

Numerous gas wells have been found to leak around the outer conductive pipe. In one test conducted by the Safety and Health Division of the Department of Employment, Economic Development and Innovation, Queensland, Australia, May 2010, "58 wells were tested at one of the Queensland Surat Basin gas fields. Of those wells, 26 were found to be leaking, including one of which was well over the explosive limit, four that were at or over the 10% over the limit, and twenty-one that had minor leaks." As a result of these test results, a new Queensland Government Code of Practice for detecting and managing gas emissions at CSG well sites was enacted. "Companies must now immediately fix leaks that fall over the reportable level, even those which may have a very low volume of gas and report those leaks to the Government's Petroleum and Gas Inspectorate." Note the current number of gas wells drilled in Queensland as at March, 2013 is around 3,000 with another 40,000 planned to be drilled in Queensland gas fields.

World-first research from two scientists at Southern Cross University, New England, Australia, has found methane levels in the air and water in areas where coal seam gas mining has taken place are up to 10 times the methane levels found in unmined areas. Dr Isaac Santos and Dr Damian Maher, scientists attached to the Southern Cross University, Armidale, NSW, Australia, took thousands of air and water samples from gas fields near Tara in Southern Queensland, Australia and compared them with samples from the Northern Rivers region, New South Wales, where a number of coal seam gas wells have been proposed. They found methane levels in creeks around Tara, Queensland, Australia, were up to 10 times higher than in the Northern Rivers, New South Wales and up to three times higher in the atmosphere. Tara residents have been complaining of previously unknown illnesses. ABC Tue Dec. 18, 2012 10:20 am AEDT:—"A Western Downs community group in southern Queensland says more families are now reporting health problems they believe are caused by nearby coal seam gas (CSG) fields." Another health concern is the presence of the radioactive gas "Radon" which can be present in coal seam gas.

Another potential form of contamination occurs from surface water around a wellhead due to leaching of contaminants either from the drilling operations, ie. fracking, or from accidental spillage during operation and maintenance of the wellhead, ie. oil, grease and well water.

Clearly it would be advantageous if a system and method for the detection and containment of leaking gas and fluids from around wellheads could be devised that helped to at least ameliorate some of the shortcomings described above. In particular, it would be beneficial to create a fugitive gas and effluent detection and collection system which overcomes one or more of the above problems thereby significantly mitigating both environmental and personal safety risks and significantly reducing the carbon footprint of each gas wellhead and/or provide the consumer with an effective risk management plan and commercial means to reduce the potential loss of commercial quantities of gas at some wellheads that would have been otherwise lost.

SUMMARY OF THE INVENTION

In accordance with a first aspect, the present invention provides a wellhead leak detection and collection system comprising a well site, the wellhead leak detection and collection system comprising: at least one collection member adapted to be placed adjacent a wellhead and adapted to receive fluid leaking from and around the wellhead conductive pipe and the wellhead; a flexible cover, covering at least the adjacent areas around the wellhead and the at least one collection member; and a fluid detector in fluid communication with the at least one collection member.

Preferably, the fluid leaking from and around the wellhead may comprise both gas and liquid. The at least one collection member may be a porous conduit. The porous conduit may be a perforated pipe having holes sized to allow the transmission of the liquid and gas into the pipe. An example of a porous hose is the 3331HM dripping hose made by Holeman Industries and slotted agricultural (AG) pipe.

Alternatively, the porous conduit may be a porous hose, the porous hose being manufactured from an extruded porous rubber and/or plastic material. Preferably, a material such as an inert plastic DHPE (high density polyethylene) can be used.

Preferably, the system may comprise a plurality of porous conduits wherein the porous conduits may comprise a combination of one or more perforated pipes and/or one or more porous hoses. Each porous conduit may be positioned under the flexible cover around the wellhead and secured to the wellhead using adhesives and/or the like, with the conduits joined together in such a fashion so as to collect leaked gas or liquid from in and around the wellhead and the well site.

Preferably, the system further comprises at least one chamber designed to fit around the conductive pipe of the wellhead, wherein liquid and gases leaking directly from around the conductive pipe may be directed into a collective base collar of the chamber.

Preferably, a fluid collection trench may be located around the outside perimeter of the well site, the fluid collection trench being in fluid communication with the at least one chamber. The fluid collection trench and the at least one chamber may be connected via an S trap which is designed to allow liquids to flow to the fluid collection trench and to have a sealing liquid column that prevents the collected leaking gases from escaping to the fluid collection trench.

Preferably, at least one gas chamber may be located within the well site and with at least one sump in fluid communication with and spaced apart from the at least one gas chamber. Both gas and liquid may be directed to the at least one gas chamber and when the liquid in the gas chamber reaches a pre-determined level the liquid is transferred to the least one sump. The at least one sump and the at least one gas chamber may be connected via an S trap located in the at least one sump, the S trap is designed to allow liquids to flow to the at least one sump and to have a sealing liquid column that prevents the collected leaking gases from escaping to the at least one sump. The length of the S trap may be calculated from the gas over pressure reading for the well site.

Preferably, a fluid collection trench may be located around the outside perimeter of the well site, the fluid collection trench being in fluid communication with the at least one sump and the at least one gas chamber.

Preferably, the system further comprises gas and liquid pumps for respectively pumping gas and liquid from the at least one sump and at least one gas chamber, wherein the gas and liquid pumps may be located adjacent each other within the well site such that a common feed from a hydraulic power unit can be utilized, or from an on-site electric generator. Liquid collected in the at least one sump may be pumped from the sump via a liquid meter or liquid flow detector to a main waste pipe, wherein the liquid is then either pumped to a collection dam or waste liquid treatment plant. The treatment plant may be a reverse osmosis plant for removing salts and other fluid contaminants from the collected liquid.

Preferably, the liquid collected in the at least one sump may contain any one of high or low pH, total dissolved salts (TDS), total suspended solids (TSS), chlorides, iron, manganese, sodium, strontium, lead, arsenic, sulphate, nitrate, bacteria, oil/grease, gross alpha radon, radium and other heavy metals that have leached from the coal seam beds below to around the wellhead.

Preferably, gas collected in the at least one gas chamber may be pumped via a metering valve and a flow detector valve to the main gas line of the well site. Alternatively, gas collected in the at least one gas chamber may be pumped to a main gas/liquid separator and then to the main gas line of the well site.

Preferably, the at least one sump may further comprise a foot valve, a non-return valve and a float valve, the foot and non-return valves are located in the pump line in the at least one sump and the float valve is located in the sump and controls the liquid pump.

Preferably, the flexible cover may comprise an impervious material. Alternatively the flexible cover may comprise any or more of the following: a) a poly-fabric; b) a polyethylene based poly-fabric; c) a plastic or polyvinyl chloride (PVC) sheet/foil material; d) an impervious sprayed polyurethane sealant onto a geo-fabric or woven/knitted mat sheet; e) an impervious liner with a porous lining on the bottom; or f) an impervious liner with a porous lining on the bottom and on the top. For example, Canvacon E 5000, a polyethylene based polyfabric sold by Gale Pacific Limited. Another example is an inert high density polyethylene membrane such as Layfield's Enviro Liner 6000HD material. Another example of a sprayable polyethylene based poly-fabric is Eraspray ESM900a sprayable polyethylene based modified polyurea product sold by ERA Polymers Pty Ltd.

A skilled addressee will understand that any suitable flexible cover may be used such as plastic sheet/foil material, PVC sheeting/foil, impervious fabrics, sprayable polyurethane and/or the like.

Alternatively, the flexible cover may comprise a multilayer construction comprising a bottom geo-fabric sheet, a top geo-fabric sheet, with the two geo-fabric sheets separated by a mesh sheet. The flexible cover may comprise an impervious liner with a porous lining on both the bottom and top of the impervious liner, wherein soil contamination is minimised by the installation of a woven/knitted/spun fabric on the top and on the bottom, giving a three layer construction on each side of the impervious liner comprising an impervious liner, a porous fabric and a soil retention fabric.

Preferably, the porous lining may be positioned around the wellhead and the at least one collection member such that any liquid/gas leaking from the ground can flow through and along the porous lining to the at least one collection member. The porous lining may comprise a spun fabric such as a spun geo-fabric, or a woven/knitted fabric.

Preferably, the flexible cover may be wide enough to enclose the adjacent area to the wellhead such that any surface backfill puts pressure on the flexible cover to keep it in place relative to the wellhead.

Preferably, the flexible cover may be a poly-fabric and is placed around the wellhead such that adjacent sides of the flexible cover overlap and were the flexible poly-fabric cover overlaps are sealed with a sealant or welded. Perimeter edges of the flexible cover and the porous linings may be folded over into a perimeter drainage channel, the perimeter drainage channel is lined with similar flexible material as the flexible cover, in such a manner that allows any fluids draining from under the flexible cover to be collected and drained to a perimeter collection sump.

On top of the flexible cover, a similar porous lining may be installed, with a woven porous top cover to minimise soil contamination of the outer porous layer, on top of the porous lining a back fill of crushed gravel or soil is laid on top to protect the flexible liner/cover from UV sunlight deterioration and to allow vehicle traffic over the flexible cover for work and maintenance of the wellhead. The geo-fabric and the mesh actually forms a conduit over the whole underside of the membrane for gas to be transported to the porous gas gathering (AG pipe) lines. The materials are laid out as a "sandwich" with geo-fabric/mesh/geo-fabric either side of the membrane joined together by welding or gluing on site or in the factory.

A benefit of this is that the overlap assists in sealing the flexible cover in at least one direction. Typically any backfill will assist in sealing the overlap of the flexible cover. Preferably the flexible cover is attached to itself where it overlaps, by gluing or welding of joining materials.

Where the wellhead is not in the centre of the membrane, the membrane is cut to fit around the wellhead, then mechanically sealed to the conductive wellhead pipe by stainless steel clamps and sealed with sealant to form a gas tight seal, The membrane is sealed around the wellhead by welding or by a mechanical joining sealing system consisting of solid sheets bolted together with gas sealant and bolts.

Preferably, the bottom of the at least one gas chamber may be open and lined with a layer of gravel to allow liquid from the surrounding ground around the wellhead to enter the at least one gas chamber. The side of the gas chamber is perforated with a series holes to allow any collected fugitive gas to enter the gas chamber. The perforated sides of the gas chamber are covered with geo-fabric to prevent soil contamination of the gas chamber.

As a consequence, the present invention has incorporated an alternative collection system that may or may not involve burning off the collected fugitive gases.

In one form but not necessarily the broadest form, the present invention is designed to capture fugitive leaked gases around a wellhead and prevent them escaping to the atmosphere. Coal seam methane gas is twenty-two times more polluting than carbon dioxide. The reduction of the carbon foot print is enhanced by pumping the fugitive leaked gas back into the gas discharge pipe which collects the well head gas for transport to a gas treatment plant and compressor station.

Another form of this invention is designed to capture fugitive leaked gases from around a wellhead and prevent them escaping to the atmosphere. The fugitive gases may then be burnt off to minimise the carbon foot print and environmental impact.

Another form of this invention is designed to capture fugitive leaked wellhead effluents, much of which contains high or low pH, total dissolved salts (TDS), total suspended solids (TSS), chlorides, iron, manganese, sodium, strontium, lead, arsenic, sulphate, nitrate, bacteria, oil/grease, gross alpha radon, radium and other heavy metals that have leached from the coal seam beds below to around a wellhead. Leaked well effluents are collected in a sump and pumped to the well effluent waste pipe which is pumped to a collection dam and waste water treatment plant, such as a reverse osmosis plant to remove all salts and other fluid contaminants.

Another form of this invention is designed to capture, as a result of rainfall, contaminants (i.e. oils, greases and spilt effluent liquids) within the enclosure which will drain into the perimeter trench for collection to the sump and thereafter such oils, greases and effluent liquids are subsequently pumped into the separator for treatment: Thus further damage and pollution by dangerous contaminants which would otherwise emanate from the well site to local waterways and land will be minimised if not eradicated; the gas company will meet its environmental obligations and satisfy the requisite Environmental Protection Authority requirements; and the integrity of any organic farming and grazing practices and land owner's accreditation will be preserved.

In another embodiment, the at least one fluid collection member may be a plurality of fluid collection members including one or more porous conduits and/or one or more sumps. This can be beneficial to help in collecting smaller ground leaks.

The flexible cover may be typically coloured to provide a visual indication when the area around the wellhead is being excavated (e.g. to act as a warning).

Preferably in one form of the invention: the flexible cover comprises an impervious liner with a porous lining on the bottom.

The fluids from the perimeter sump can be pumped back into the wellhead take-off pipe, thus minimising any pollution by contaminating effluents released to the environment.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

DETAILED DESCRIPTION OF THE INVENTION

The following description, given by way of example only, is described in order to provide a more precise understanding of the subject matter of a preferred embodiment or embodiments.

Figure 1:
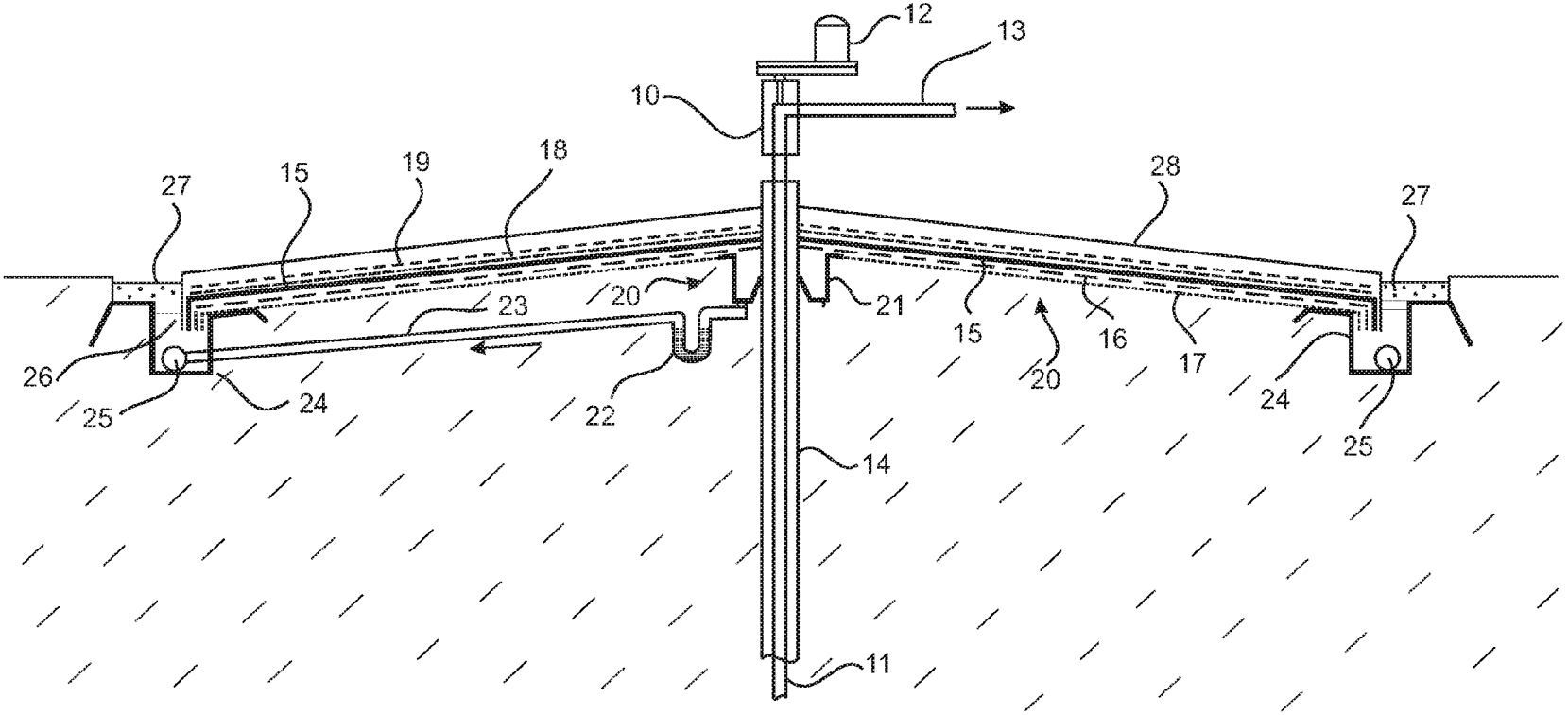
FIG. 1 shows a cross section of a wellhead conductive pipe and fugitive gas and effluent collection system according to an embodiment of the present invention.

With reference to FIG. 1, there is shown part of a wellhead system, wellhead 10. A conductive pipe 11 is filled with high strength concrete grout between drill pipe 14 and the conductive pipe 11. A pipe 13 carries CSG gas and coal seam effluent/water fluid to a gas separation chamber. The surrounding area around the wellhead is covered with formed earthworks 20 sloping out to perimeter fugitive effluent collection trench 24. The sloping earthworks 20 are covered by a series of gas conductive fabric in layers to form fugitive fluid and gas seals around the wellhead 10. The first layer can be a woven wed mat fabric 17 which acts as a soil barrier in contact with earthworks 20. The next layer can be a geo-fabric 16 which will act as a conduit for the collection of fugitive gases to the gas chamber 21. The flexible impervious cover 15 is laid or sprayed over the fabrics, 16 and 17. As a further part of the embodiment of this patent another two fabric layers, geo-fabric 18 and woven weed mat 19 may be laid over the flexible cover 15, these porous fabrics are protected with a porous layer of crushed gravel 28 and acts as a conduit for the collection of contaminated surface water from the area around the wellhead 10 to the perimeter collection trench 24.

Figure 2:
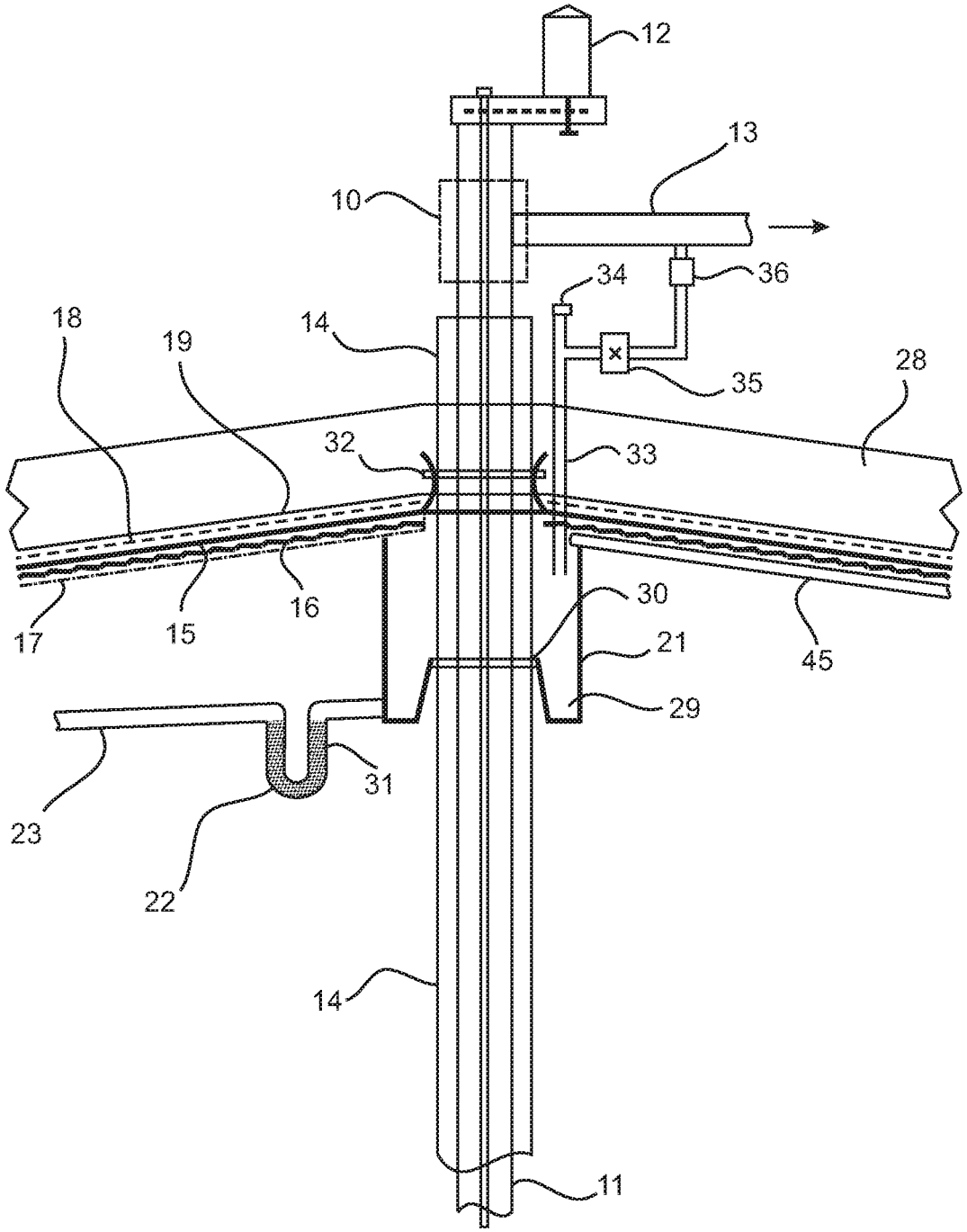
FIG. 2 shows a detailed side view of a wellhead and gas collection chamber with flexible cover attached to the conductive wellhead pipe according to an embodiment of the present invention.

FIG. 2 shows a detailed cross section of a wellhead 10 with a fugitive gas/effluent recovery system and central gas collection chamber 21 with a porous hose 45 connected from under the flexible cover and interconnecting perimeter porous hoses 44. The flexible cover is sealed onto the conductive pipe 11 with sealant and a pipe clamp 32. The central gas chamber 21 is drained of fugitive fluids 31 that ooze up around the conductive pipe 11, via opening 30, and into the bottom trough 29 of the central gas chamber 21, via a drainage pipe 23 with a water/fluid "S" trap 22 to prevent the loss of fugitive gas from the central gas chamber 21. The "S" trap 22 can be refilled with water via the screw cap 34.

The presence of fugitive gas in the central gas collection chamber 21 can be tested for pressure and concentrations at outlet pipe 33 via screw cap 34. The captured fugitive gases are pumped with the pump 35 from gas exist pipe 33 into the main exist gas/fluid pipe 13. A non-return valve 36 is positioned between the pump 35 and the pipe 13. There is no carbon footprint or atmospheric contamination due to the normal burning of fugitive gases in a flaring pit. The water in the coal seam below is pumped up the central drilled pipe 11 with the wellhead pumps driven by the top motor 12. The flexible cover 15 is gas/fluid impervious and is sandwiched between bottom porous fabric layers 16, 17 and top porous fabric layers 18, 19. The bottom porous fabric layers 16, 17 act as a conduit for captured fugitive gases that will travel up and be collected into the central gas chamber 21. The top porous fabric layers 18, 19 act as a conduit for any surface contaminations that may have been spilt around the wellhead 10. The top porous fabric layers 18, 19 are covered with a porous covering of crushed gravel 28 which will protect the fabric layers from U.V. light damage and allow machinery to move over the wellhead pad for well maintenance.

Figure 3:
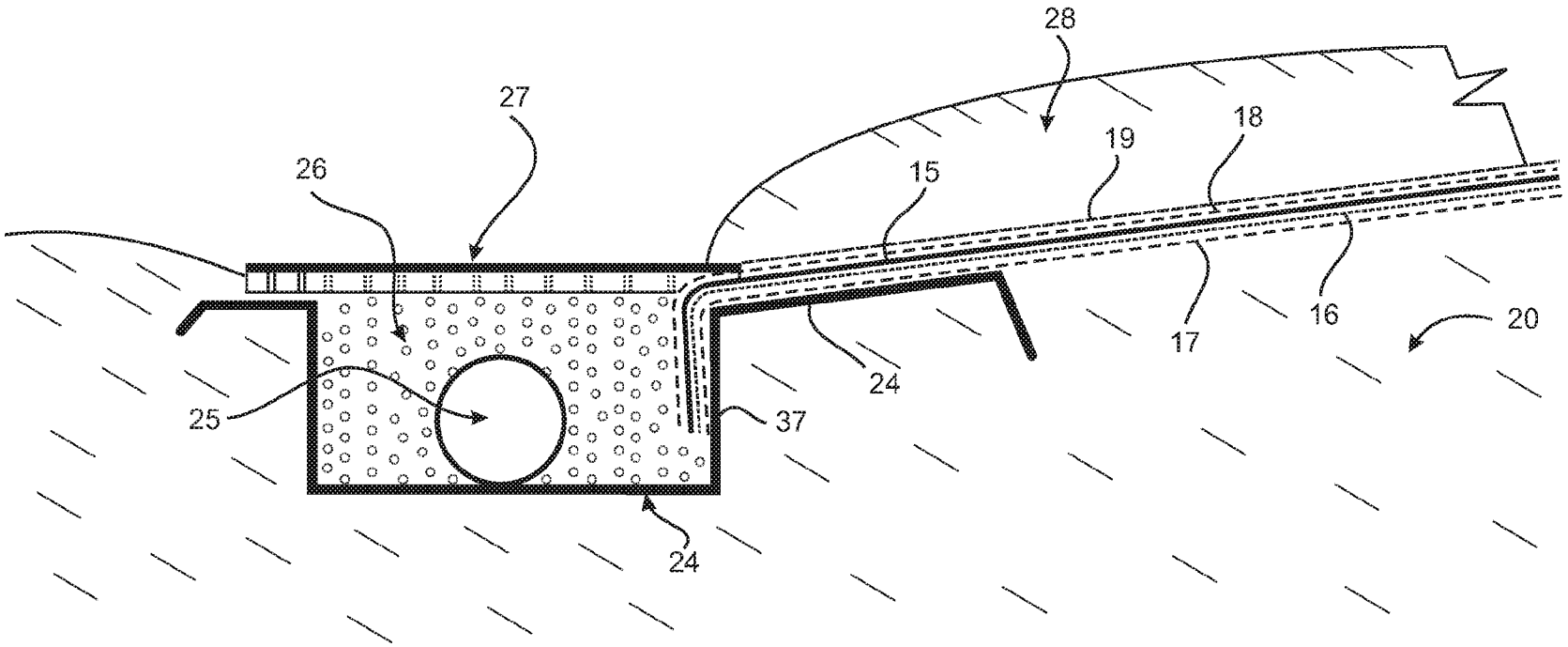
FIG. 3 shows a side view of an outer collection trench according to an embodiment of the present invention.

FIG. 3 shows a cross section of a perimeter trench lined with an impervious sheeting 24, with a slotted drainage pipe 25 in the bottom of the perimeter trench. The trench is filled with crushed stone 26 and capped with a drainage grating 27 for machinery access across the perimeter trench. The perimeter of the impervious flexible cover 15 is designed to allow any fugitive fluids 31 collected from under the impervious flexible cover 15 to drain via the gap 37 into the perimeter trench.

Figure 4:
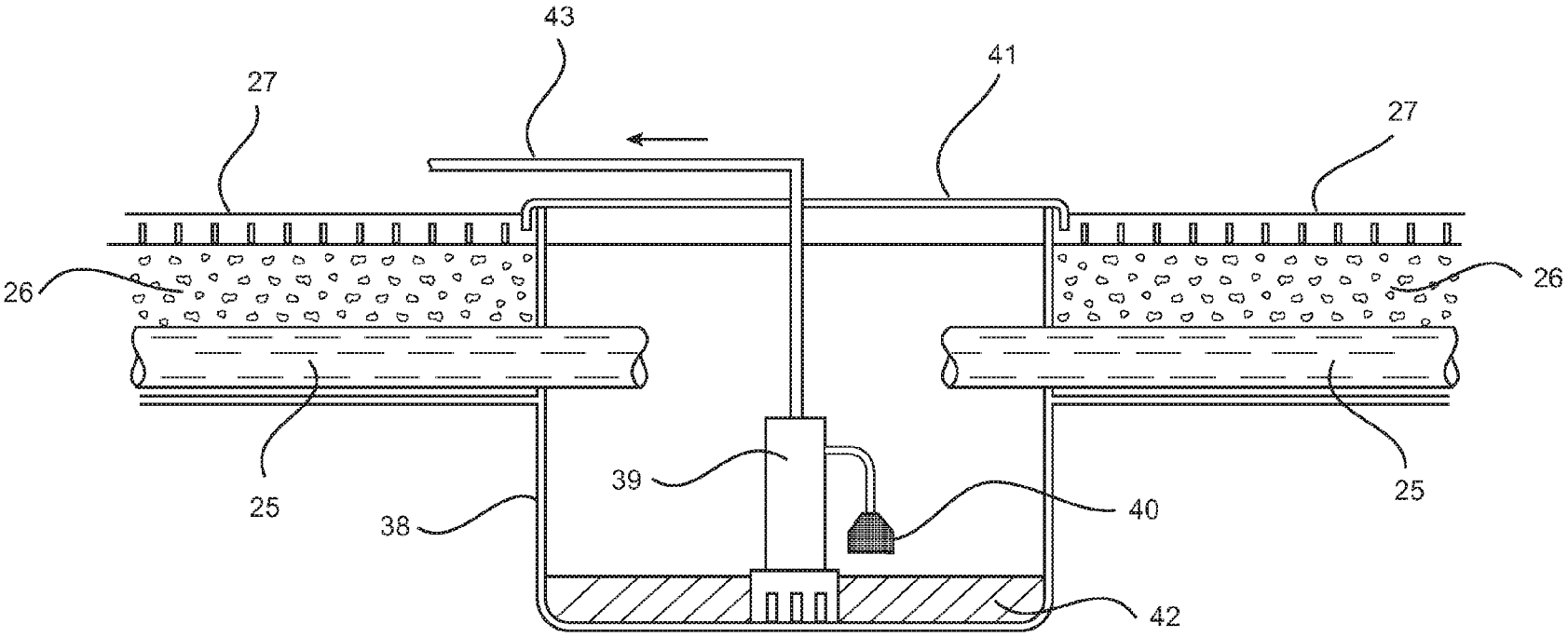
FIG. 4 shows a side view of a outer collection sump according to an embodiment of the present invention.

FIG. 4 shows a cross section of the sump 38 for the collection of fugitive fluids 31 and well pad rain water run off into the perimeter trench. The perimeter slotted drainage pipe 25 drains into the sump 38 with a cover 41. The collected sump fluids 42 are pumped out with an automatic sump pump 39 and an auto float switch 40 out of the sump 38 via a pipe 43 directly into wellhead pipe 13 for treatment in the gas/water separator.

Figure 5B:
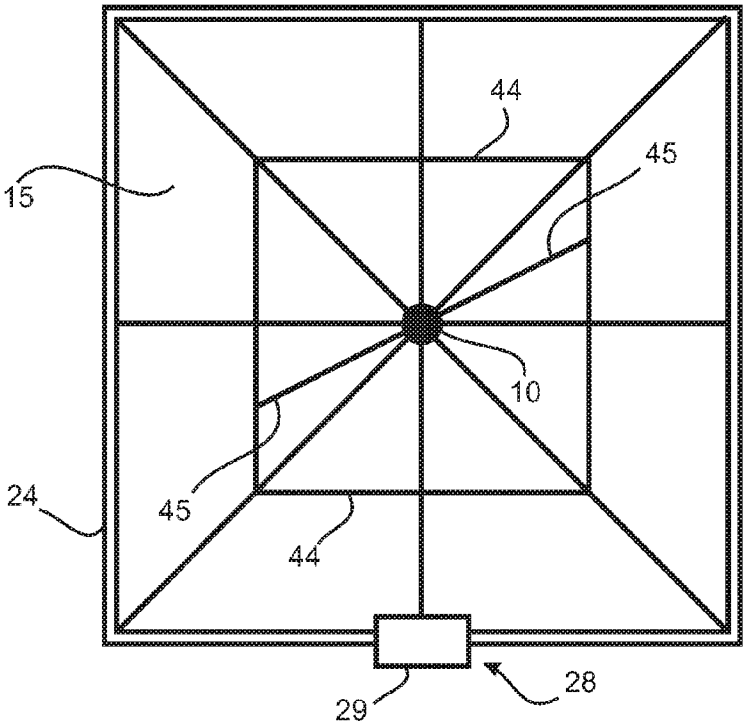
FIG. 5(*a*) and FIG. 5(*b*) shows top views of wellheads and surrounding flexible covers of various configurations with a perimeter effluent collection trench and sump according to an embodiment of the present invention.
Figure 5A:
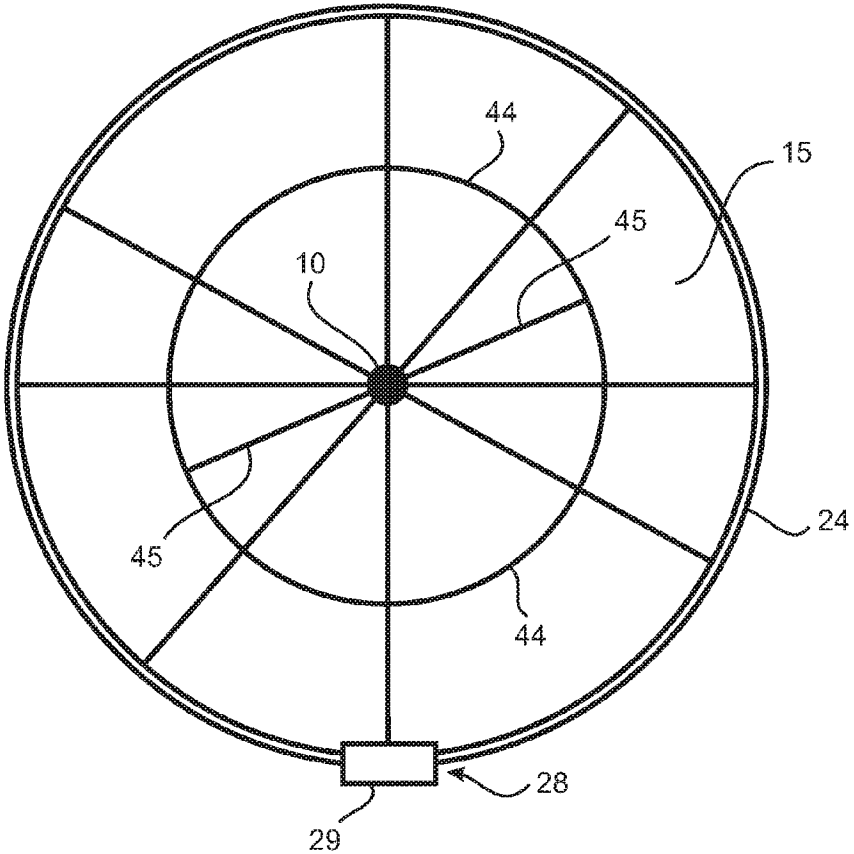

FIG. 5(*a*) shows a circular plan view of a wellhead 10 with a fugitive gas/effluent recovery system installed with a central gas collection chamber 21 and midway porous gas collection hoses 44, connected under the flexible cover 15 to interconnecting porous hoses 45 and are attached together and terminated into the collection gas chamber 21. An advantage of having porous hoses 44, 45 under flexible cover 15 is that pockets of fugitive gas are collected and transported to the collection chamber 21 located around the base of the conductive pipe 11.

FIG. 5(*b*) shows a rectangular plan of a wellhead 10 with a fugitive gas/effluent recovery system installed with a central gas collection chamber 21 and a midway porous gas collection hoses 44, connected under the flexible cover 15 to interconnecting porous hoses 45 and are attached together and terminated into the collection gas chamber 21.

Figure 6:
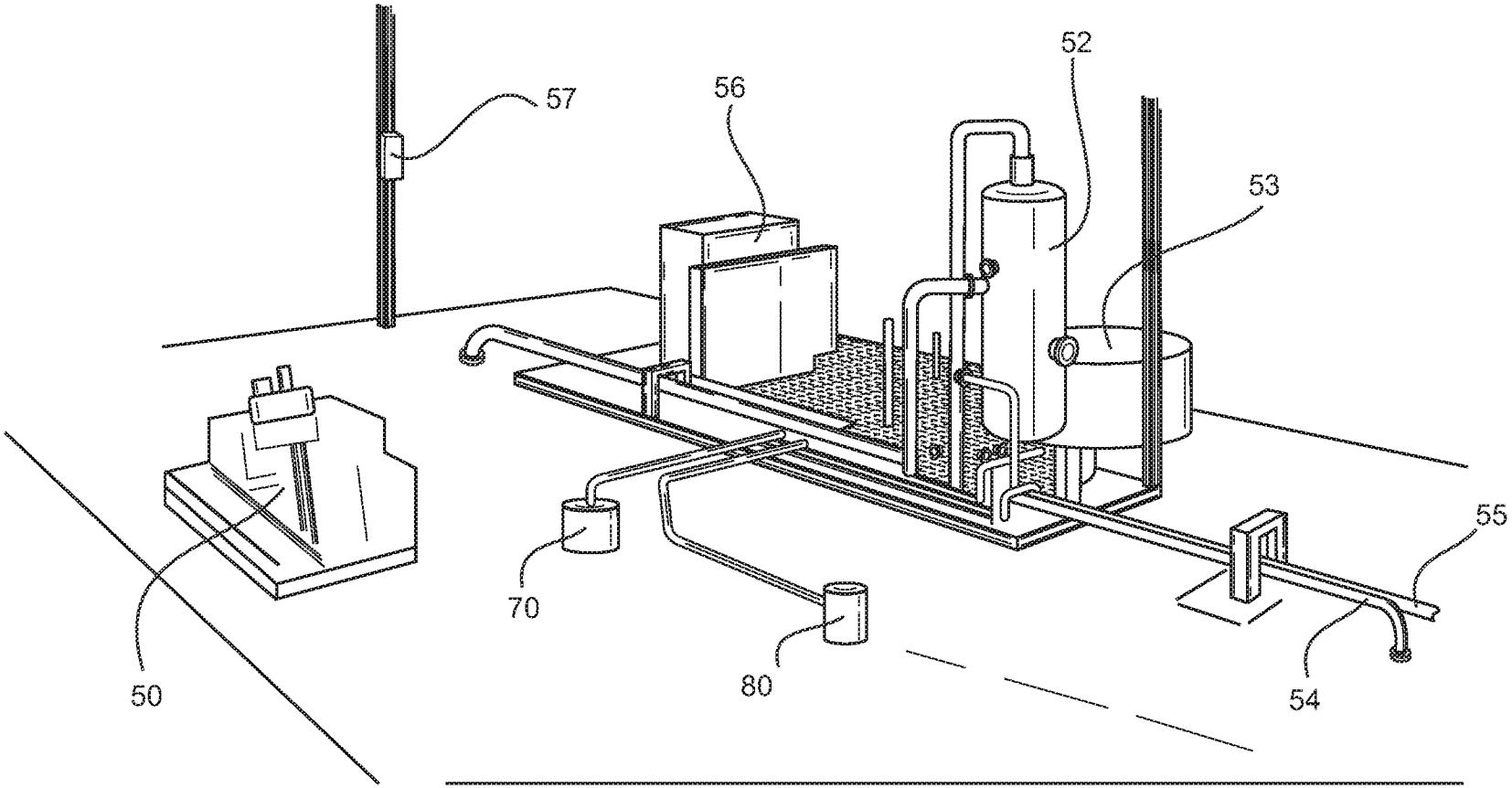
FIG. 6 illustrates a perspective view of a typical gas well in which the present invention can be installed.

FIG. 6 illustrates a three dimensional perspective view of a Coal Seam Gas (CSG) well site. CSG is methane gas found in coal seams. The methane lies in pores and 'cleats' in the coal seams and is trapped there by water. CSG is extracted via wells that are drilled into the coal seams to release the trapped gas. A typical site comprises a wellhead which provides a safe pressure seal to control the flow of gas and water. A hydraulic power unit powers a pump at the bottom of the well. Due to the inherent flammable nature of the methane gas the use of electrical motors is restricted. A remote terminal unit is located close to the perimeter of the site and links the well to a remote control system for remote monitoring and operation of the well site. A separator is also used to further measure and separate gas and water coming out of the well. Any fine particles of rock that collect in the separator are subsequently collected in a solids disposal tank located next to the separator. Finally a typical CSG well site also includes a number of gathering lines. The gathering lines are underground pipes that carry gas and water to processing facilities.

Figure 7:
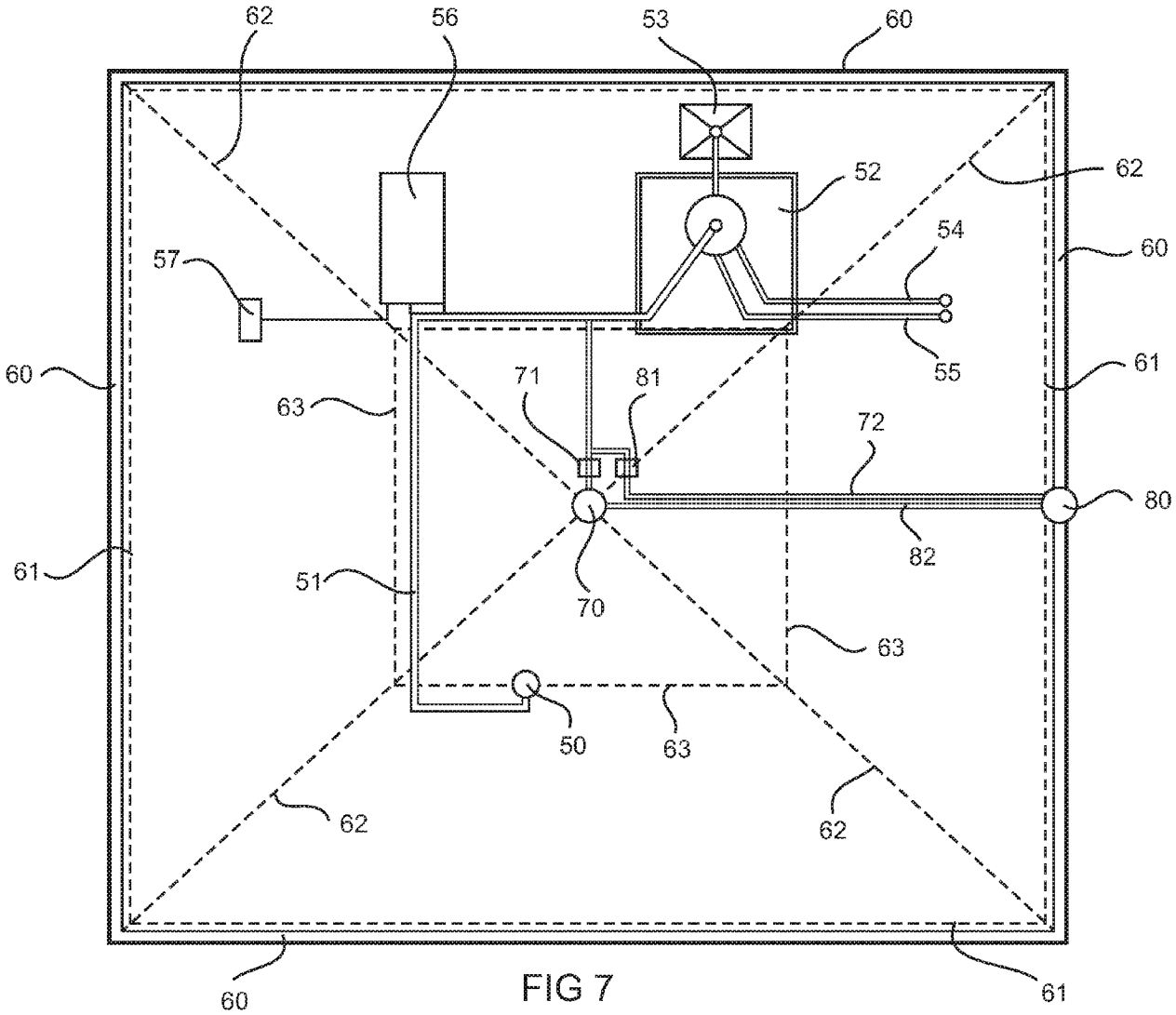
FIG. 7 illustrates a typical site layout diagram of a wellhead conductive pipe and fugitive gas and effluent collection system according to another embodiment of the present invention.

FIG. 7 shows a site layout of a preferred embodiment of the present invention. There is shown a wellhead system, wellhead 50 having a conductive pipe filled with high strength concrete grout between the drill pipe and the conductive pipe. A pipe 51 carries CSG gas and coal seam effluent/water fluid to a gas separation chamber 52. The separator 52 also includes a solids disposal tank 53 located next to the separator 52 to remove any fine particles of rock that collect in the separator 52. Gathering lines 54, 55 connect the separator 52 to the site gas and water mains, the gas and water mains can then be transferred to further processing plants. Also located within the well site are the hydraulic power unit 56 and the remote terminal unit 57.

The surrounding area around the wellhead 50 is covered with formed earthworks sloping out to the perimeter collection trench 60. The sloping earthworks are covered by a flexible cover 90 comprising a series of gas conductive fabric in layers 91 to form fugitive fluid and gas seals around the wellhead 50, the gas chamber 70 and the sump 80.

The fugitive gas/effluent recovery system includes a central gas collection chamber 70 with a number of porous pipes 61, 62, 63 connected from under the flexible cover 90. A sump 80 is located at or near one side of the well site in fluid communication with the gas collection chamber 70 and the fluid collection pipes 65. The gas collection porous pipes 61, 62, 63 are laid above the effluent/fluid slotted collection pipes 65, with porous pipes 61, 62, 63 and slotted collection pipe 65 laid beneath the flexible cover 90. The effluent/fluid slotted collection pipes 95 drain directly into the sump 80. The sump 80 is connected to the gas collection chamber 70 by pipe 82. The pipe allows the transfer of fluid or effluent received in the gas collection chamber 70 to the sump 80. A suction pipe 72 connected to the fluid pump 81 allows the sump 80 to be connected to the separator 52 for transfer of the fluid/effluent to the water mains 54 or a dam (not shown). The water can also be transferred to an external water treatment facility such as a reverse osmosis treatment plant. It should be appreciated by the skilled addressee that a number of other water treatment plants could be devised to further treat the fluid from the well site.

Figure 8:
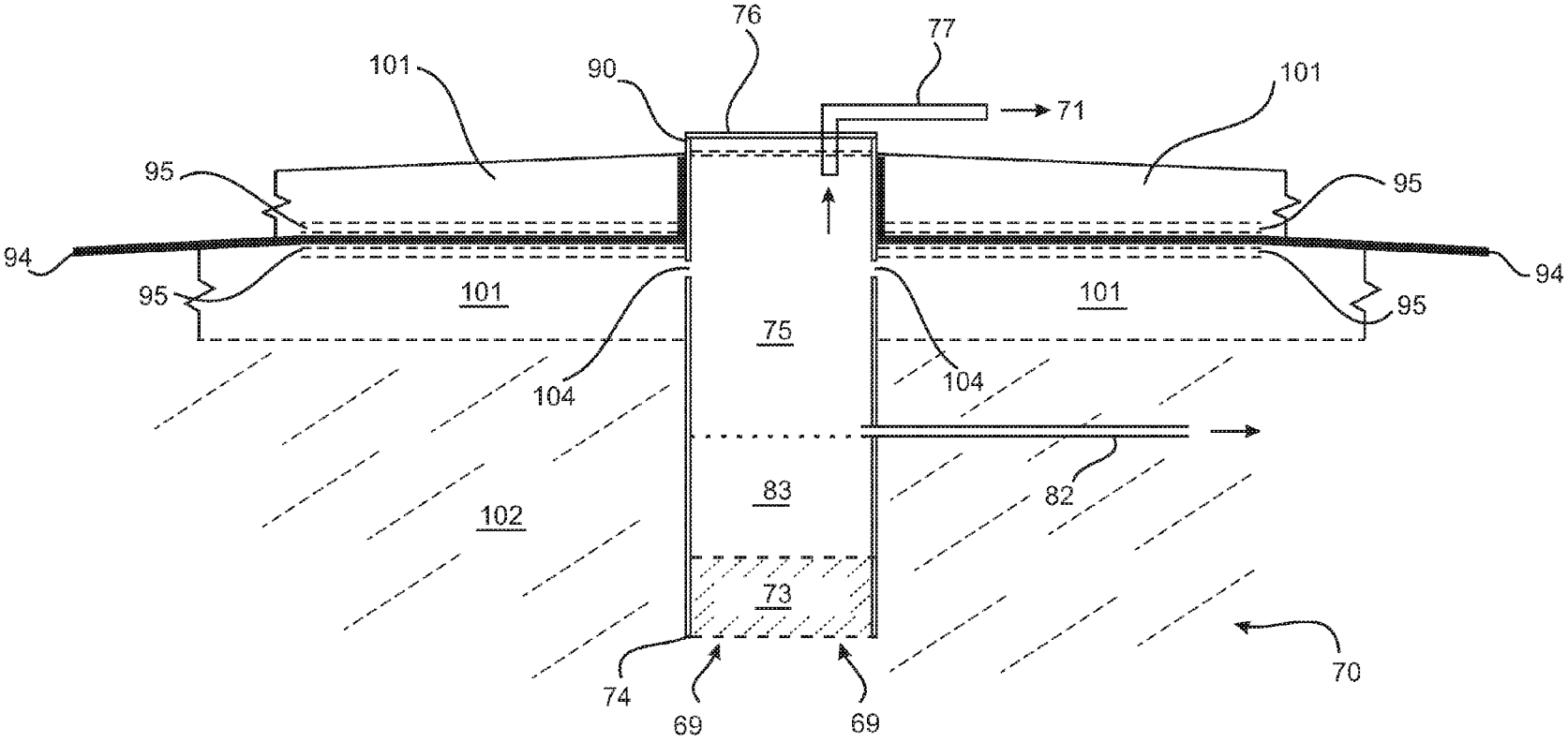
FIG. 8 shows a detailed cross-sectional side view of a gas chamber in accordance with the wellhead conductive pipe and fugitive gas and effluent collection system of FIG. 7.

Typically the top slotted or porous pipe 61 is laid into the gravel 101 so that it is partially exposed to enable gas 75 collected under the flexible cover 90, which forms an impervious membrane, to enter the slots in the pipe 61 and thereafter be transported to the central gas chamber 70. Similarly gas pipes 62, 63 are laid directly from the gas chamber 70 to around the wellhead 50. There are a number of these gas gathering pipes 61, 62, 63 installed under the flexible cover 90 which are directed to the central gas chamber 70 resulting in the gas pressure under the flexible cover 90 being minimised and equalised and thereby minimising the chance of localised uplifting of the flexible cover 90 due to localised over-pressure FIG. 8 shows a detailed drawing of the gas chamber 70. The gas chamber 70 is connected to a gas pump 71 to allow the collected gas in the gas chamber 70 to be transferred to the separator 52. The gas undergoes a final treatment in which any remaining liquid is separated from the gaseous component for transfer from the separator 52 to the gas mains. The gas may also be connected from the gas mains to a further treatment plant (not shown).

The gas chamber 70 has cover 76 closing one end of the chamber the other end 74 is open but covered with a layer of gravel 73. The top cover 76 is welded to the gas chamber forming a gas tight seal. The gas chamber 70 is protected by a safety explosion venting/pressure relief membrane (not shown) fitted into the top of the lid or cover 76. For example, a safety explosion venting/pressure relief membrane produced by Fire Protection Pty Ltd. The open end 74 allows the effluent fluids 83 to seep through the gravel 73 in the direction of arrows 69 and enter into the bottom of the gas chamber 70. A layer of effluent liquid 83 is contained within the bottom of the gas chamber 70 and is drawn out of the gas chamber 70 through the effluent/liquid pipe 82 and into the sump 80. Surrounding the top of the gas chamber 70 is a gravel fill 101 which slopes down and away from the gas chamber 70 to the outer perimeter trench 60. The layer of gravel 101 is placed on top of the flexible cover 90. In this embodiment the flexible cover 90 comprises membrane 94 and a geo-fabric and mesh layers 95 on either side of the membrane 94. Another layer of gravel 101 is placed immediately below the flexible cover 90 and above the natural ground 102. A gathering gas line 77 passes out through the top cover 76 of the gas chamber 70 to connect the gas pump 71 to allow the gas 75 to be pumped from the gas chamber 70 to the separator 52. The gas chamber 70 includes perforated holes 104 in the sides of the gas chamber 70. The perforated holes 104 allow the gas 75 located under the flexible cover 90 to enter into the gas chamber 70.

Figure 9A:
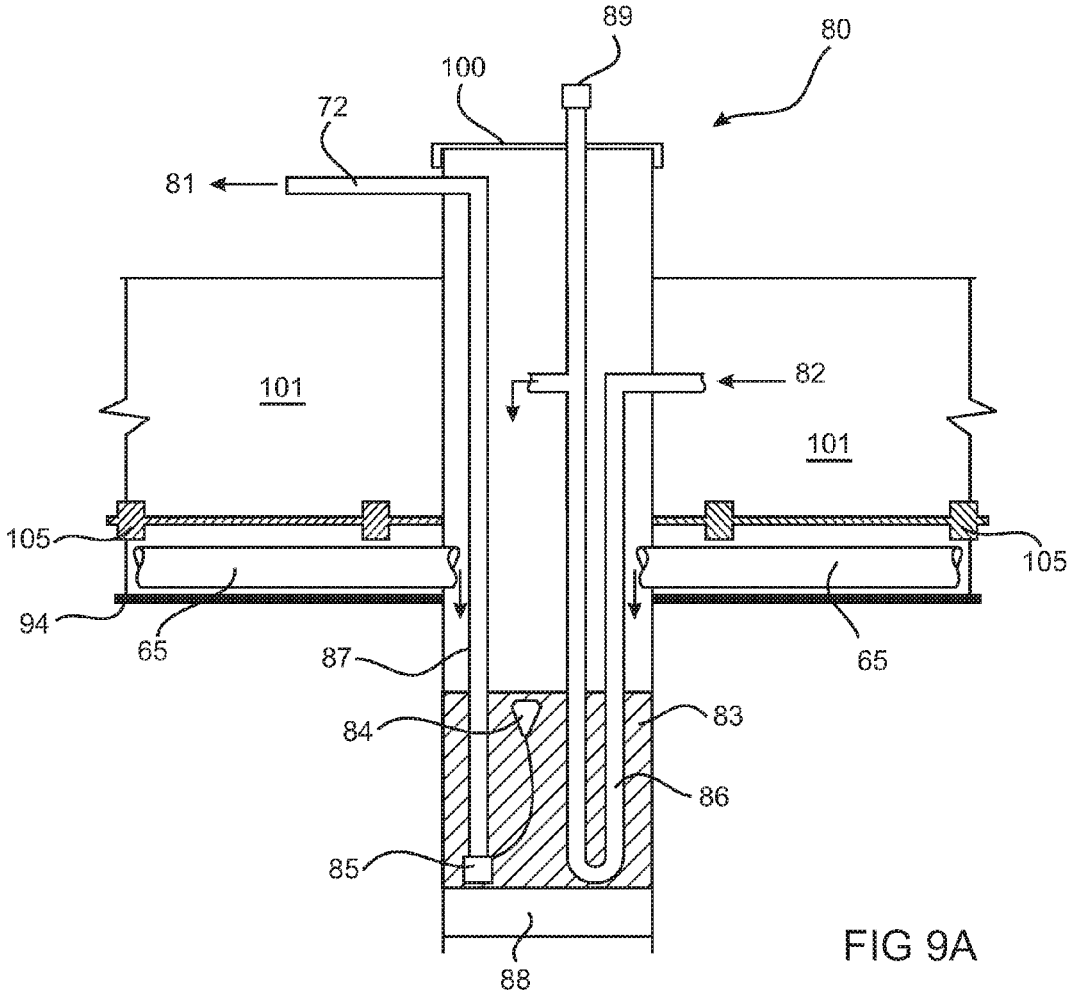
FIG. 9A shows a side view of a sump of a wellhead conductive pipe and FIG. 9B shows a side view of a fugitive gas and effluent collection system of FIG. 7.

Both the gas pump 71 and the liquid pump 81 are located adjacent to each other in order to utilise a common hydraulic feed from the hydraulic power unit 56 to drive both pumps. Alternatively, if a gas/petrol/diesel driven power unit 56 is used in place of the hydraulic power unit a common drive from the unit is utilised to drive both the gas pump 71 and the liquid pump 81. Located in close proximity to the gas pump 71 is a gas flow meter or gas detector (not shown). As the skilled addressee would know there are a number of options for the measurement or detection of gas flow. For example, gas flow can be measured in volumetric or mass flow rates, such as liters per second or kilograms per second. Typically when gases are transferred for their energy content, such as the sale of natural gas, the flow rate may also be expressed in terms of energy flow, such as GJ/hour or BTU/day. The energy flow rate is the volume flow rate multiplied by the energy content per unit volume or mass flow FIG. 9A shows a detailed drawing of the sump 80. The collected effluent fluids 83 are pumped out of the sump 80 by liquid pump 81. A foot valve 85 acts as a non-return valve at the inlet end of suction pipe 87. The foot valve 85 or non-return valve in used in the pump suction pipe 87 to prevent the pump draining or de-priming when not in service or use. The pump 81 is activated by a float switch 84. For example, the float switch 84 may be used to detect the level of liquid within the sump 80 and turn the liquid pump 81 on and off as required. The float switch 84 may also be used as an indicator or an alarm. It should be appreciated that any number of devices may be utilised to activate the fluid pump 81. Likewise any number of devices may be utilised in order to indicate the flow of liquid within the fugitive gas/effluent recovery system. For example, mechanical flow meters or pressure based meters could easily be utilised in the present system. As another alternative an automatic sump pump (not shown) may be located within the sump 80 with an auto float switch 84. The alarm may be connected to the remote terminal unit within the well site. If the sump 80 is filling up over the safety level, the alarm will be activated to send a signal to central control. The physical draining by pumping out the liquid in the sump 80 and outer perimeter trench 60 by a field unit tanker will then be required. Thus stopping any environmental pollution to the surroundings which would otherwise arise.

An S-trap 86 is utilised in the sump 80. Because of its shape, the trap retains a certain amount of fluid within the S-trap 86. The fluid/water/effluent 83 in the S-trap 86 creates a seal that prevents gas 75 from passing from the effluent pipe 82. The S-trap 86 includes a filler pipe which has a removable cap 89 and allows the fluid inside the S-trap 86 to be maintained at a required level. Maintaining the water seal is critical to the S-trap 86 operation; traps can and do dry out, and poor venting can siphon or blow water out of the traps. The maximum pressure of the gas chamber 70 is set by the length of the water column in the "S" trap and is calculated to prevent over pressurising of gases under the membrane. The filler pipe passes through the top cover 100 of the sump 80. At the other end of the sump 80 a concrete base 88 closes off the bottom of the sump 80. Venting holes are drilled into the top lid 100 of the sump 80 for the relief of any discharged gases.

The sump 80 is typically located to one side of the well site. However it will be appreciated that the location of the sump 80 may vary from site to site. In FIG. 7 the sump 80 is located centrally on one side of the well site and at or around the outer perimeter trench 60. The sump 80 is substantially buried in the ground. At the top of the sump 80 a layer of crushed gravel 101 is positioned around the sump 80. Under the crushed gravel 101 the slotted pipe 65 is laid in position. The slotted pipe 65 is placed at a certain level below the crushed gravel 101 such that the slotted pipes 65 terminate and enter the sump 80 at a central location along the sides of the sump 80. The distance below the surface that the slotted pipes 65 are placed is typically around 600 mm. However it is to be appreciated that this depth may vary. The porosity of the well site soil may vary greatly making it difficult to maintain a gas seal around the perimeter of the outer trench 60. This problem is overcome by installing a horizontal sealing bar 105 which is used to push against the membrane 94 on the side of the trench 60 utilising screw clamps. The membrane 94 can also be gas sealed by injecting sealing expandable foam or mastic behind the membrane 94 and the soil walls of the trench 60.

The sump 80 may be manufactured from any suitable material which can safely retain the effluent or fluid from an oil or coal seam wellhead 50. For example, a high density polyethylene (HDPE) or any polyethylene thermoplastic made from petroleum. HDPE is known for its large strength to density ratio and is commonly used in the production sumps and other plastic products.

As described above a suction pipe 72 connected to the fluid pump 81 allows the sump 80 to be connected to the separator 52 for transfer of the fluid/effluent to the water mains 54 or a dam (not shown).

Figure 9B:
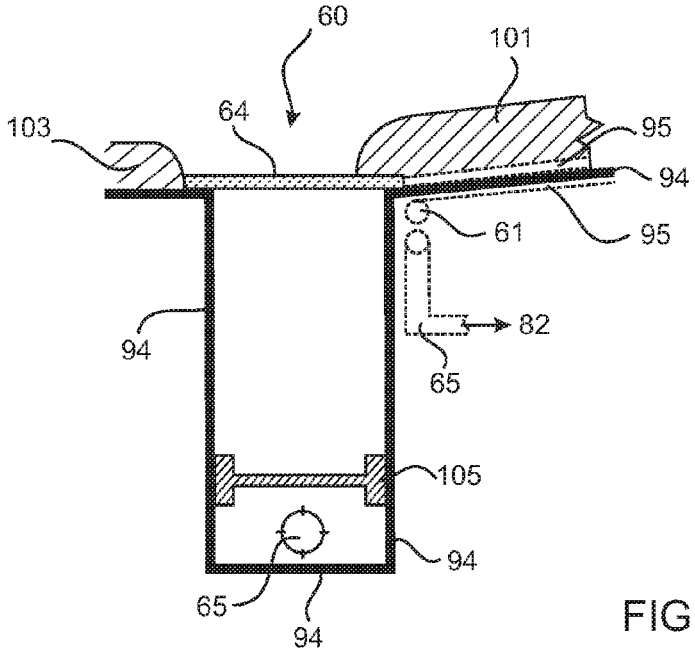

Also shown in FIGS. 9A and 9B is an outer perimeter collection trench 60 which comprises a trench filled with crushed gravel 101 with a slotted pipe 65 laid in a position around 600 mm from the surface or from the grate 64. The collection trench 60 is located around the outer perimeter of the well site and the shape of the outer perimeter is dependent upon the site location and generally is either a round perimeter as shown in FIG. 5(*a*) or can be a square shaped perimeter as shown in FIG. 5(*b*). As appreciated the shape and size of the perimeter is variable and is generally dependent upon site location of the wellhead and associated well production equipment used and slopes around the well site.

As shown in FIGS. 9A and 9B the gravel fill 101 slopes down from the gas chamber 70 in the middle of the well site to the collection trench 60 located around the perimeter of the well site. As will be appreciated the slope down to the collection trench 60 is in order to capture any effluent or rainwater which has been leaked onto the well site and may vary from site to site. A layer of crushed gravel 101 is placed above the flexible cover 90. The flexible cover 90 comprises membrane 94 and a geo-fabric and mesh layers 95 on either side of the membrane 94. The flexible cover 90 provides a gas seal around the perimeter collection trench 60.

Figure 10A:
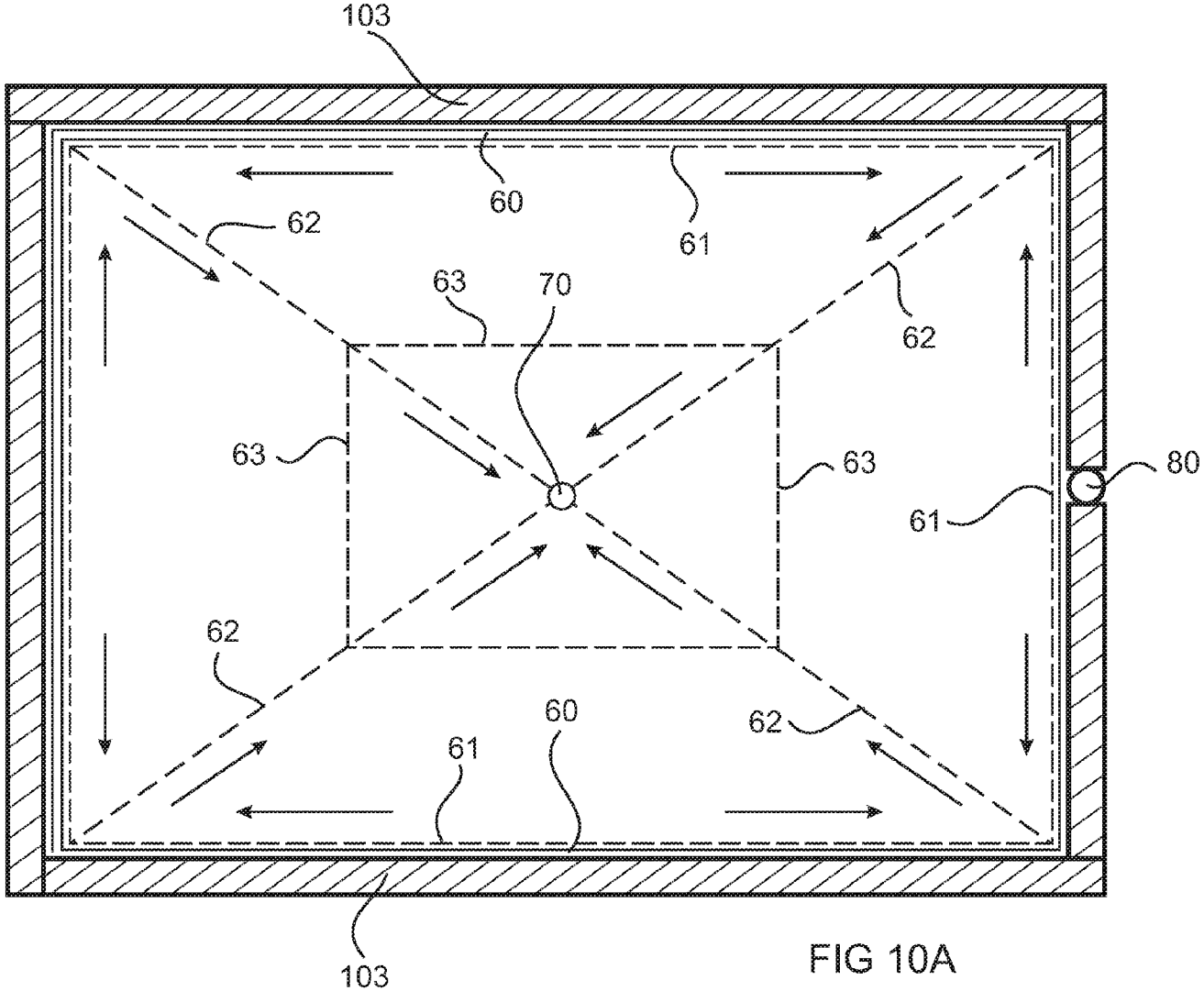
FIG. 10A illustrates the collection of fugitive gas from a wellhead conductive pipe.
Figure 10B:
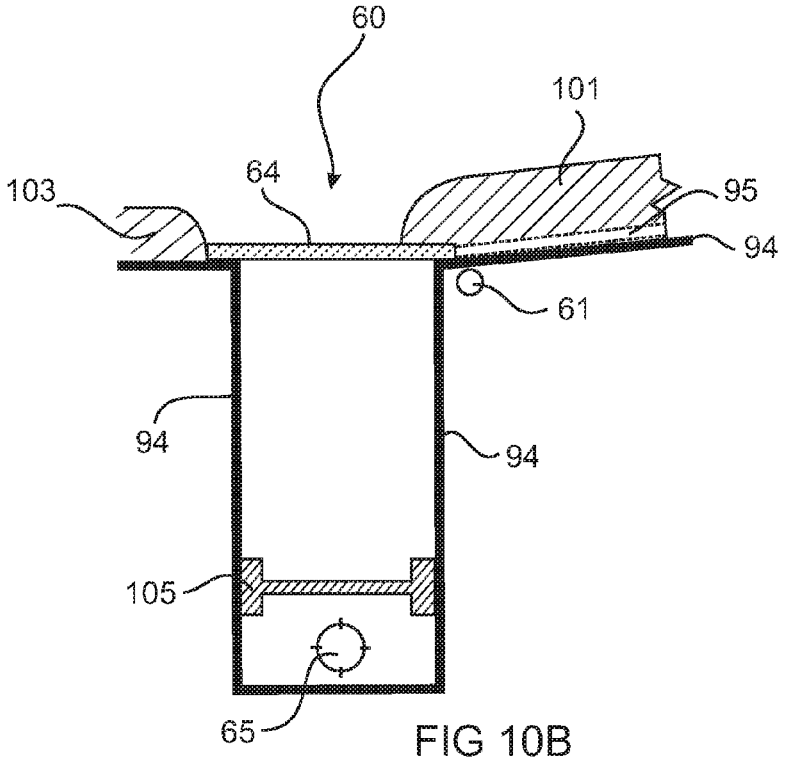
FIG. 10B shows a side view of and fugitive gas and effluent collection system and FIG. 10C shows a side view of a central gas collection chamber.
Figure 10C:
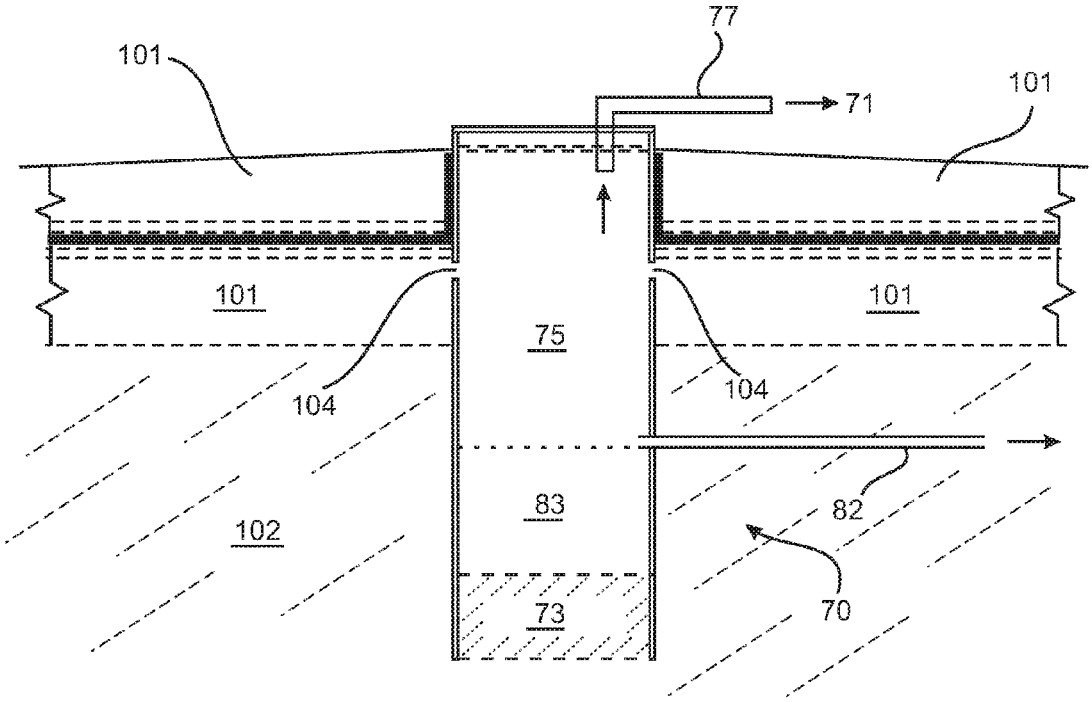

FIGS. 10A-10C illustrate the collection of fugitive gas 75 from a typical well site with the arrows indicating the typical flow of gas 75 throughout the system. Intermediate porous pipes 63 are positioned between the interconnecting perimeter porous pipes 61 and the gas collection chamber 70. Porous pipes 62 located on the diagonals of the well site connect the perimeter porous pipes 61 to the intermediate porous pipes 63 and finally to the gas collection chamber 70. The gas chamber 70 includes perforated holes 104 in the sides of the gas chamber 70. The perforated holes 104 allow the gas 75 located under the flexible cover 90 to enter into the gas chamber 70. The well site also includes a bund 103 surrounding the perimeter collection trench 60.

As the fluid leaking from and around the wellhead 50 may comprise both gas 75 and liquid 83 a slotted pipes 61, 62, 63, 65 may be utilised as the main collection member within the well site. Alternatively a porous conduit may also be used, such that the porous conduit consists of a perforated pipe having holes sized to allow the transmission of the liquid 83 and gas 75 into the pipes 61, 62, 63, 65. An example of a porous hose is the 3331HM dripping hose made by Holeman Industries. It should be appreciated that any number of different types of pipes or porous hoses may be used to collect the fugitive gas and liquid from around the well site. For example, any one of porous conduits 61, 62, 63, 65 may be a porous hose, the porous hose being manufactured from an extruded porous rubber and/or plastic material. Likewise any combination of porous hoses or slotted or perforated pipes may be positioned under the flexible cover 90 and located in any number and any configuration around the well site. As such hoses and conduits located around the well site are connected together by adhesives or the like to form a network of underground collection pipes. The collection pipes 61, 62, 63 are sealed and secured to the gas chamber 70 and the sump 80 by adhesives or other fixing devices such as pipe clamps. Therefore the conduits 61, 62, 63 are joined together in such a fashion so as to collect leaked gas 75 from in and around the wellhead 50 and the well site. Likewise the pipes 65 are joined together in such a fashion so as to collect leaked effluent/liquid from around the site for transfer to the sump 80.

Figure 11A:
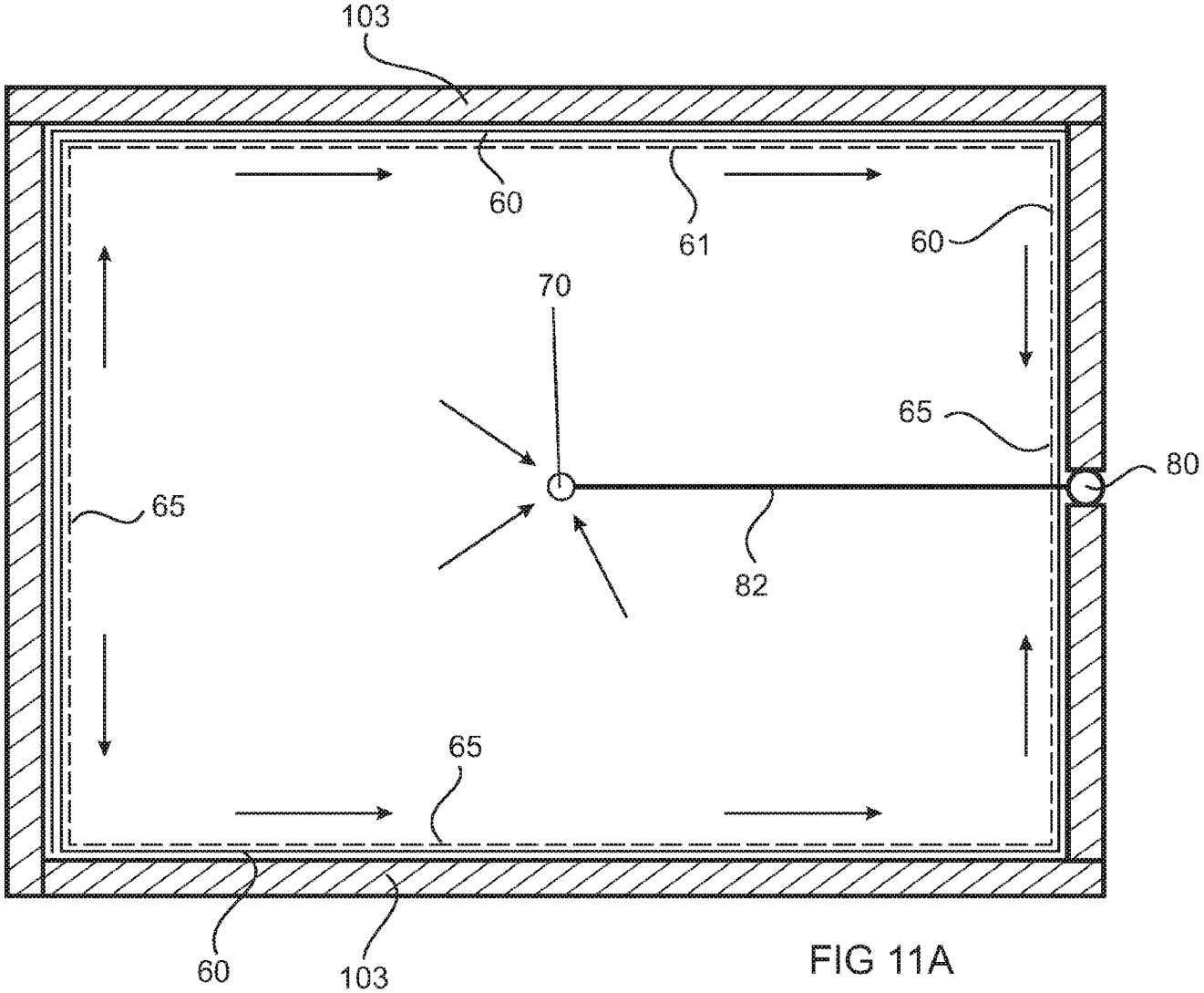
FIG. 11A illustrates the collection of effluent liquid from a wellhead conductive pipe.
Figure 11B:
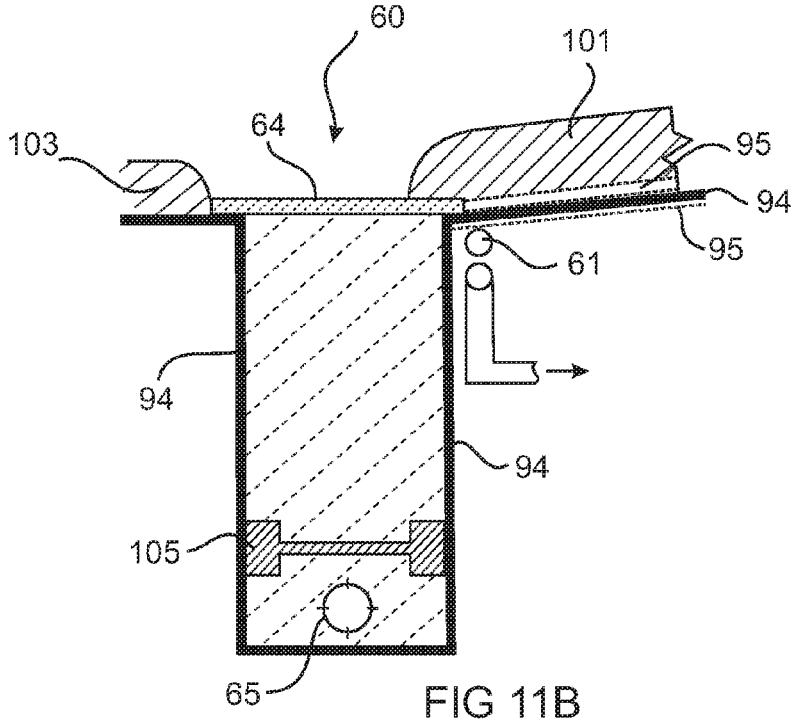
FIG. 11B shows a side view of a fugitive gas and effluent collection system and FIG. 11C shows a side view of a sump of a wellhead conductive pipe.
Figure 11C:
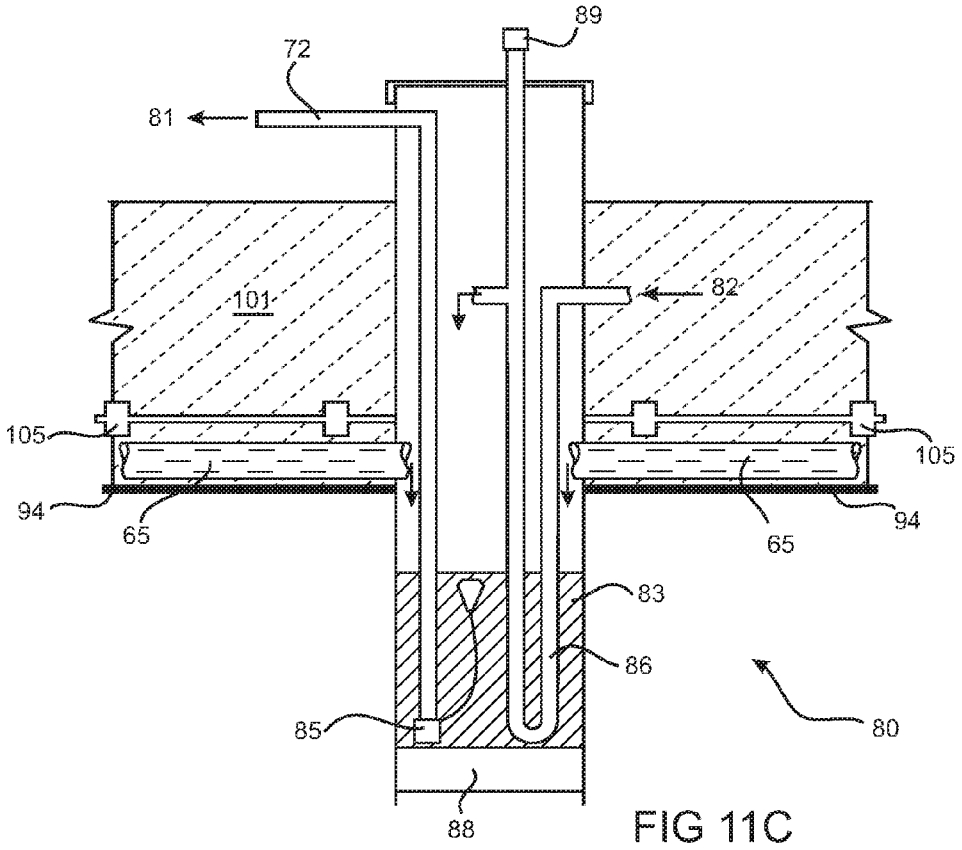

FIGS. 11A-11C illustrate the collection of effluent fluid 83 from a typical well site with the arrows indicating the typical flow of fluid 83 throughout the system. Effluent 83 is collected in the perimeter collection trenches 60 and in the outer perimeter slotted pipes 65. The fluid 83 will either flow directly into the sump 80 or from the gas chamber 70 via pipe 82. The fluid 83 enters the gas chamber 70 through the gravel 73 in the base of the gas chamber 70. The well site also includes a bund 103 surrounding the perimeter collection trench 60. FIGS. 11B and 11C also show a horizontal sealing bar 105 which is used to push against the membrane 94 on the side of the trench 60 utilising screw clamps. The membrane 94 can also be gas sealed by injecting sealing expandable foam or mastic behind the membrane 94 and the soil walls of the trench 60.

Figure 12A:
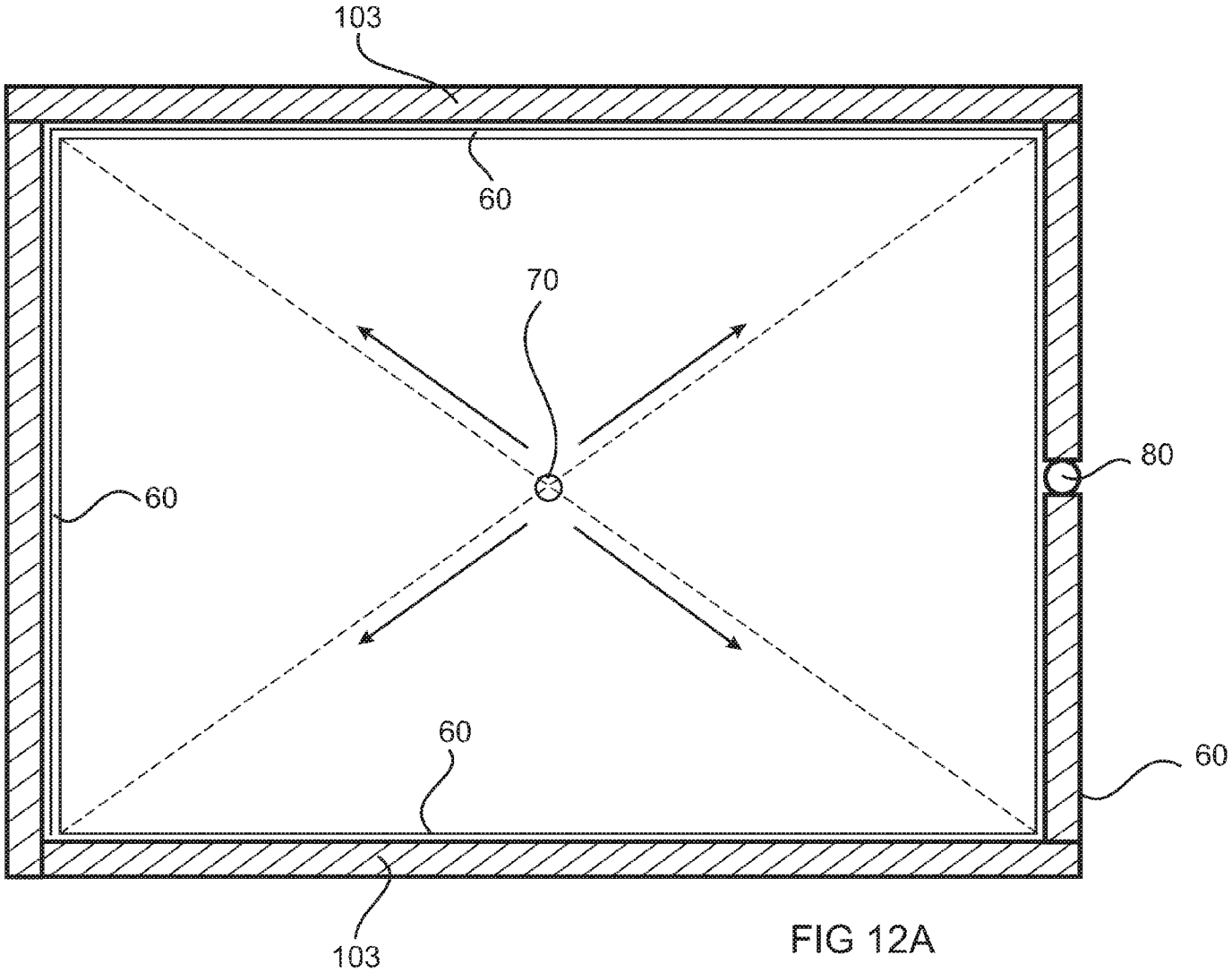
FIG. 12A illustrates the collection of surface water and silt containment around and on a wellhead conductive pipe.
Figure 12B:
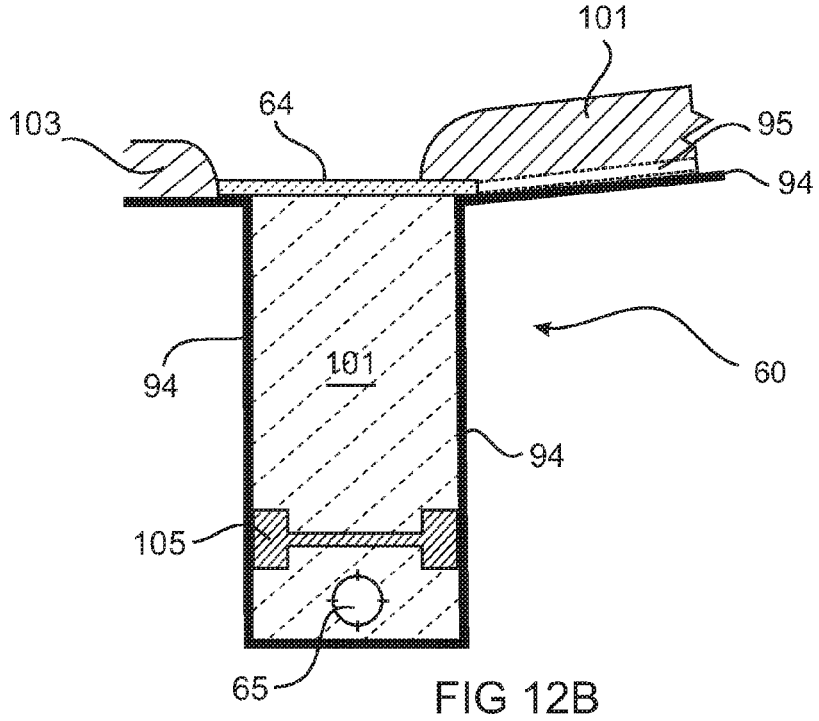
FIG. 12B shows a side view of a fugitive gas and effluent collection system.
Figure 12C:
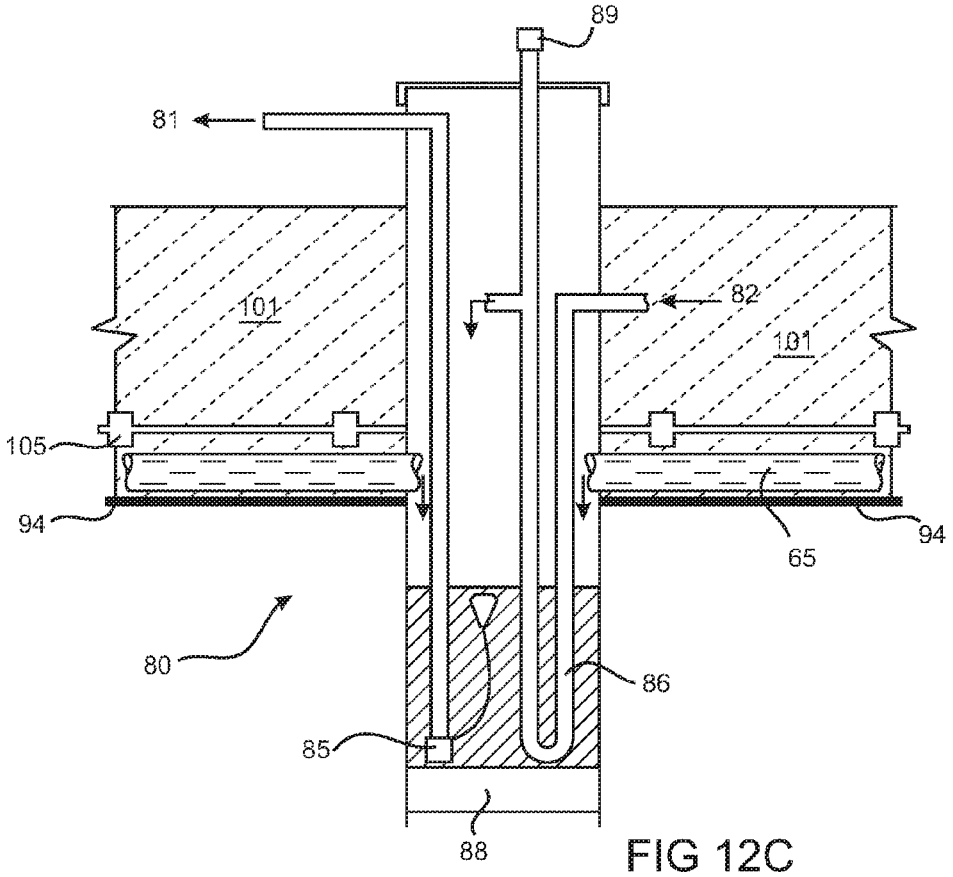
FIG. 12C shows a side view of a sump of a wellhead conductive pipe.

FIGS. 12A-12C illustrate the collection of surface water or spilt contaminants from around a typical well site. Also illustrated by the arrows the site slopes down and away from the gas chamber 70 in the centre of the well site towards the outer perimeter collection trench 60 and the sump 80. The design of the sloping gravel away from the centre of the site prevents ponding of water and allows the capture of any surface water or spilt contaminants in the outer collection trench 60. An embankment or bund 103 is located around the outside of the perimeter collection trench 60 so that any fluid which is washed down towards the collection trench 60 and flows over the trench 60 will not flow away from the wells site because the bund 103 will prevent this errant flow. The bund 103 also prevents surface water from outside of the well site from entering the outer perimeter collection trench 60.

The present invention has been described in relation to a flexible cover 90 consisting of a number of gas conductive layers or a layer sandwich. In the present embodiment the flexible cover 90 comprises a membrane 94 and on either side of the membrane 94 are a geo-fabric and mesh layer 95. It will be appreciated that the number of layers and the constructions of those layers can be provided in a number of different options. Therefore the constructions of the flexible cover 90 has been described above it should be noted that an skilled addressee would recognise the variances and combinations of construction of the flexible cover 90. It should also be appreciated that the flexible cover 90 can be designed to fit any shape or configuration required for any existing well site or any new well site and may be manufactured in the factory or fabricated on-site by the installer.

Another example of the flexible cover 90 which can be used in conjunction with the present invention consists of three distinct layers. A first multi-layer sheet comprising a top layer of geo-fabric material, a middle plastic reinforcing mesh and a bottom layer of geo-fabric material, a second or middle layer comprising an enviro liner such as Layfield's Enviro Liner 6000HD and a third multi-layer sheet the same as the first layer. This combination or sandwich of layers forms a flexible cover 90 that will withstand mechanical damage from equipment installed on top of the finished well site surface.

The flexible cover 90 is sealed onto the gas chamber 70 with sealant and/or a pipe clamp 32 to form a gas seal around the gas chamber 70. Likewise the flexible cover forms a fluid or liquid seal around the perimeter trench 60 and or sides of the sump 80.

In another arrangement and as illustrated in FIGS. 1 to 4 the flexible cover 17 may be formed from a first layer such as a woven wed mat fabric which acts as a soil barrier in contact with earthworks 20. The next layer can be a geo-fabric 16 which will act as a conduit for the collection of fugitive gases to the gas chamber 21. The flexible impervious cover 15 is laid or sprayed over the fabrics, 16 and 17. As a further part of the embodiment of this patent another two fabric layers, geo-fabric 18 and woven weed mat 19 may be laid over the flexible cover 15, these porous fabrics are protected with a porous layer of crushed gravel 28 and acts as a conduit for the collection of contaminated surface water from the area around the wellhead 10 to the perimeter collection trench 24.

In accordance with the present invention the fluid detector in fluid communication with the fluid collection AG pipes 61, 62, 63 is a gas detector device which detects the presence of various gases within an area as part of a safety system. This type of equipment is used to detect a gas leak and interface with the remote terminal unit to the central control system so a process can be automatically shut down. Gas detectors can be classified according to the operation mechanism (semiconductors, oxidation, catalytic, infrared, etc.). The present gas detectors are fixed gas detectors and are located in and around the well site. For example, a gas detector may be located in the gas chamber 70, in or under the flexible cover 90, within the slotted or perforated collection pipes 61, 62, 63.

Installation & Operation

The present invention of a wellhead leak detection and collection system will now be described in relation to the installation and use of the system.

A. Initial Well Site Preparation and Well Drilling:

(1) Company prepares the site essentially according to its normal operations;

(2) Well site is drilled and capped;

(3) Gas and water gathering lines are then installed by gas company for well completion before the FEI System is installed; and (4) System contractor then installs the wellhead leak detection and collection system.

B. Site Preparation for the Wellhead Leak Detection and Collection System:

(1) The site must be bare of any well completion equipment i.e. hydraulic power unit and separator;

NOTE: for installation of the wellhead leak detection and collection system at existing wells, such wells will need to be shut down and the site cleared temporarily.

(2) The system contractor prepares site for installation of impervious membrane by placement of gravel around the site selected for installation of the gas chamber collection system with a gentle slope from the central point of the gas chamber to the perimeter of the site (graded and gently compacted);

(3) Perimeter trench is dug to a depth subject to well site soil conditions; the excavated soil is retained to form the perimeter bund on completion of installation;

(4) The gas chamber pipe is installed by drilling a hole the required diameter and depth using a bobcat and auger in the exact centre of the membrane cover; and (5) A similar diameter hole is drilled for the sump to the specified depth as calculated to take into account the over-pressurisation of gas under the impervious membrane that may arise due to failure of on-site equipment and pumps.

NOTE: if over-pressurisation occurs under the membrane, then the safety override of system in the design of the water "S" trap will be activated.

C. Effluent Liquid Collection System

The system contractor then installs the outer effluent liquid collection AG pipes, which are located on the inside of the top wall of the outer trench. The centre gas chamber is connected to the sump system along with the effluent drain pipes to the "S" trap inside of the sump.

D. Fugitive Gas Collection System:

(1) The top porous AG pipe being installed is utilised for fugitive gas collection purposes. The porous AG pipe is laid into the gravel so that it is partially exposed to enable gases collected under the impervious membrane to enter the slots in the AG pipe and thereafter be transported to the central gas chamber or to the gas chamber around the wellhead;

(2) When a separate gas chamber is utilised instead of the wellhead, a similar porous AG pipe is laid directly from the gas chamber to extend around the wellhead under the membrane; and (3) There are a number of these gas gathering lines installed under the membrane which are directed to the central gas chamber resulting in the gas pressure under the membrane being minimised and equalised and thereby minimising the chance of localised uplifting of the membrane due to localised over-pressure.

Laying of the Wellhead Leak Detection and Collection System: 7 Layer Sandwich

The sandwich comprises:

1. TOP LAYER:—Fluid Conductive Layer (GSE FabriNet Geo-composite comprising):

Top layer—Geo-fabric material;

Middle layer—plastic reinforcing mesh; and

Bottom layer—Geo-fabric material

2. CENTRE LAYER:—Impervious Membrane (Layfield's Enviro Liner 6000HD Material); and 3. BOTTOM LAYER:—Gas/Fluid Conductive Layer (GSE FabriNet Geo-composite):

Top layer—Geo-fabric material;

Middle layer—plastic reinforcing mesh;

Bottom layer—Geo-fabric material

The sandwich or multi-layer flexible sheet is laid in the above order.

NOTE: the System can be designed to fit any shape or configuration of an existing well pad. Further the Geo-fabric and the mesh combination actually forms a conduit over the whole underside of the membrane for fugitive gas to be transported to the gas gathering (AG pipe) lines, connected to the central gas chamber.

Installation of Materials:

The materials are laid out as a sandwich or multi-layer panel with geo-fabrics and Enviro Liner Material joined together by welding or gluing on site or in the factory;

The system contractor lays Layfield's Enviro Liner and geo-composite "sandwich" over the prepared gravel base and then proceeds to fits the material to the gas chamber and the wellhead in a gas sealed manner. Where soil conditions and porosity require an additional gas seal bar can be installed around and onto the membrane covered side wall of the perimeter trench with adjustable screw clamps;

The system contractor then lays top protective gravel surface (quantity of gravel required to be determined according to the gas company's engineering specifications) which also serves to keep the underlying materials firm and protective from ultraviolet rays and mechanical damage.

NOTE: Access for re-working of the wellhead

Recommends that re-usable plastic drilling boards (plastic interlocking boards) are firstly laid on the gravel surface for use by the drill rig when entering the well site;

By moving over the drilling boards, little if any damage will be caused to the underlying seven layer membrane system.

D. Effluent Liquid Collection System

The system contractor then installs the sump system connecting the effluent drain pipes to the "S" trap.

E. Surface Water Collection System

1) The slotted AG pipe is laid in the bottom of the perimeter trench on top of the impervious membrane lining and terminating inside the high density polyethylene (HDPE) sump casing;

2) The perimeter trench is backfilled with porous rock.

NOTE: As a result of rainfall, contaminants (i.e. oils, greases and spilt effluent liquids) within the enclosure will drain into the perimeter trench for collection into the sump and thus such oils, greases and effluent liquids are subsequently pumped into the separator for treatment:

a) Damage and pollution by dangerous contaminants which would otherwise emanate from the well site to local waterways and land will be minimised if not eradicated;

b) The gas company will meet its environmental obligations and satisfy the requisite Environmental Protection Authority requirements; and (c) The integrity of any organic farming and grazing practices and accreditation will be preserved.

External Bund (3) The contractor installs a one meter (approx.) gravel bund utilising the excavated perimeter trench soil over the exposed membrane which is lying outside the perimeter trench; this step ensures complete sealing of the impervious membrane and also prevents external water from entering the well site.

F. Completion of System Installation

The installation of the system will then be complete and the gas company can then proceed to install the balance of the well completion infrastructure G. Conclusion System is a 3 Stage System:

Stage 1—Collection/Recovery and measurement of fugitive gases (which would otherwise escape into the atmosphere) thereby enhancing the commercial value of each gas well where the system is implemented.

Stage 2—Collection and measurement of effluent liquids leaking from around the wellhead which would otherwise pollute surrounding land Stage 3—Collection of well site surface water and any spilt contaminants Advantages The present invention has been designed to capture and contain both fugitive leaked gases and wellheads effluents around a wellhead thereby significantly mitigating both environmental and personal safety risks and significantly reducing the carbon footprint of each oil or gas wellhead and/or provide the consumer with an effective risk management plan and commercial means to reduce the potential loss of commercial quantities of gas or oil at wellheads that would have been otherwise lost.

Another important advantage that the present system is the benefit to the CSG/oil companies:

Retrofitting of the system at existing well sites is feasible and viable.

Minimal Maintenance—the system is simple, practical and effective with minimal maintenance requirements. The flexible materials used in system have a long life span (at least 30+ years) and any leaks detected after installation can be fixed easily and cheaply.

Protection of licensed to extract gas and oil from adverse government action or intervention Carbon footprint reduction resulting in minimal if any carbon tax or similar penalties.

Employee safety risk reduction—there will be less need for gas company employees to attend well sites to check for leaking fugitive gases. Employees will be traveling less on public roads to attend well sites and therefore maintenance and safety costs will be drastically reduced.

Initial outlay cost effective—One off cost of installation of the system is cost effective and there exists a real opportunity to increase company profits through recovery of valuable gases otherwise lost.

Reduction in need for reworking of well sites—existing well sites will be kept in production (rather than being decommissioned or reworked to stop existing gas leaks).

Negative Public Perception is potentially overcome—the present negative perception of CSG companies and their activities will be greatly alleviated and, in fact, the voluntary adoption of the system at the gas company well sites (both existing and future) represents a great opportunity for positive public relations to be created.

Variations

It will be realized that the foregoing has been given by way of illustrative example only and that all other modifications and variations as would be apparent to persons skilled in the art are deemed to fall within the broad scope and ambit of the invention as herein set forth.

In this specification, adjectives such as first and second, left and right, top and bottom, and the like may be used solely to distinguish one element or action from another element or action without necessarily requiring or implying any actual such relationship or order. Where the context permits, reference to an integer or a component or step (or the like) is not to be interpreted as being limited to only one of that integer, component, or step, but rather could be one or more of that integer, component, or step etc.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. The invention is intended to embrace all alternatives, modifications, and variations of the present invention that have been discussed herein, and other embodiments that fall within the scope of the above described invention.

In the specification the term "fluid" shall be understood to include a substance, as a liquid or gas or a combination of both, that is capable of flowing and that changes its shape at a steady rate when acted upon by a force tending to change its shape. The term "fluid" may also extend to include plasmas and, to some extent, plastic solids.

In the specification the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

The invention claimed is:

1. A wellhead leak detection and collection system to be used at a well site, the wellhead leak detection and collection system comprising:

at least one perforated or slotted pipe adapted to be placed adjacent a wellhead and having holes sized to allow the transmission of liquid and gas into the at least one perforated or slotted pipe, wherein the liquid and gas are leaking from a wellhead conductive pipe or a wellhead of the well site;

a flexible cover covering at least one or more areas adjacent and around the wellhead and the at least one perforated or slotted pipe; and a fluid collection trench formed around an outside perimeter of the well site, wherein an outer perimeter of the flexible cover is located within the collection trench to thereby allow any liquid or gas collected from under the flexible cover to drain into the perimeter trench.

2. The wellhead leak detection and collection system as claimed in claim 1, wherein at least one of the at least one perforated or slotted pipe is a porous conduit, and the porous conduit is a porous hose, the porous hose being manufactured from an extruded porous rubber or plastic material.

3. The wellhead leak detection and collection system as claimed in claim 2, wherein the system comprises a plurality of porous conduits, the porous conduits comprise a combination of one or more perforated pipes and one or more porous hoses.

4. The wellhead leak detection and collection system as claimed in claim 3, wherein each porous conduit is positioned under the flexible cover and secured to the wellhead mechanically and using adhesive, with the conduits joined together in such a fashion so as to collect leaked gas or liquid from within and adjacent the wellhead and the well site.

5. The wellhead leak detection and collection system as claimed claim 4, further comprising at least one chamber designed to fit around the conductive pipe of the wellhead, wherein liquid and gases leaking directly from the conductive pipe are directed into a collective base collar of the at least one chamber.

6. The wellhead leak detection and collection system as claimed in claim 5, wherein the fluid collection trench is in fluid communication with the at least one chamber, and the fluid collection trench and the at least one chamber are connected via an S trap which is engineer designed to allow liquids to flow to the fluid collection trench and to have a sealing liquid column that prevents the collected leaking gases from escaping to the fluid collection trench.

7. The wellhead leak detection and collection system as claimed in claim 4, further comprising at least one gas chamber or sump located within the well site and at least one sump in fluid communication with and spaced apart from the at least one gas chamber or sump, and wherein both gas and liquid are directed to the at least one gas chamber and when the liquid in the at least one gas chamber reaches a predetermined level the liquid is transferred to the least one sump, and wherein a bottom of the at least one gas chamber is open and lined with a layer of gravel to allow liquid from the surrounding ground around an outside perimeter of the wellhead to enter the at least one gas chamber.

8. The wellhead leak detection and collection system as claimed in claim 7, wherein the at least one sump and the at least one gas chamber or the at least one sump are connected via an S trap located in the at least one sump, the S trap is designed to allow liquids to flow to the at least one sump and to have a sealing liquid column that prevents the collected leaking gases from escaping to the at least one sump, and a length of the S trap is engineer calculated from a gas over pressure reading for the well site.

9. The wellhead leak detection and collection system as claimed in claim 8, further comprising a fluid collection trench located around an outside perimeter of the well site, the fluid collection trench being in fluid communication with the at least one sump and the at least one gas chamber or sump.

10. The wellhead leak detection and collection system as claimed in claim 9, further comprising a pressure activated gas pump and liquid pumps for respectively pumping fugitive gas and well effluent liquid from the at least one sump and the at least one gas chamber, wherein the gas and liquid pumps are located adjacent each other within the well site such that a common feed from a hydraulic power unit or an electric power unit can be utilized, and liquid collected in the at least one sump is pumped from the at least one sump via a liquid meter or liquid flow detector, via the gas/liquid separator to a main waste effluent liquid pipe, wherein the liquid is then pumped either to an off-site collection dam or waste well liquid treatment plant for removing salts and other well fluid contaminants from the collected well liquid.

11. The wellhead leak detection and collection system as claimed in claim 10, wherein the liquid collected in the at least one sump contains any one of high or low pH, total dissolved salts (TDS), total suspended solids (TSS), chlorides, iron, manganese, sodium, strontium, lead, arsenic, sulphate, nitrate, bacteria, oil, grease, gross alpha radon, radium, uranium and other heavy metals that have leaked from coal seam beds below to around the outside perimeter of the wellhead.

12. The wellhead leak detection and collection system as claimed in claim 10, wherein gas collected in the at least one gas chamber or sump is pumped via a gas metering valve and a gas flow detector valve, via a gas separator or a liquid separator to a main gas line of the well site, and the at least one sump further comprises a foot valve, a non-return valve and a float valve, the foot and non-return valves are located in the pump line in the at least one sump and the float valve is located in the at least one sump and controls the liquid pump.

13. The wellhead leak detection and collection system as claimed in claim 1, wherein the flexible cover comprises an impervious material.

14. The wellhead leak detection and collection system as claimed in claim 13, wherein the flexible cover comprises any one or more of the following:

a) a poly-fabric;

b) a polyethylene based poly-fabric;

c) a plastic or polyvinyl chloride (PVC) sheet material or polyvinyl chloride (PVC) foil;

d) an impervious sprayed polyurethane sealant onto a geo-fabric or woven mat sheet or knitted mat sheet;

e) an impervious liner with a porous lining on the bottom; or f) an impervious liner with a porous lining on the bottom and on the top.

15. The wellhead leak detection and collection system as claimed in claim 14, wherein the flexible cover comprises a multi-layer construction comprising a first layer comprising a bottom geo-fabric sheet, a top geo-fabric sheet, with the two geo-fabric sheets separated by a mesh sheet, a second layer comprising a bottom geo-fabric sheet, a top geo-fabric sheet, with the two geo-fabric sheets separated by a mesh sheet, with the impervious membrane located between the first and second layers.

16. The wellhead leak detection and collection system as claimed in claim 15, wherein the flexible cover comprises an impervious liner with a porous lining on both the bottom and top of the impervious liner, wherein soil contamination is minimised by the installation of a soil retention fabric that is woven or knitted or spun on the top and on the bottom, giving a two layer construction on each side of the impervious liner a porous fabric and a soil retention fabric, and the porous lining on the top and the porous lining on the bottom are positioned around an outside perimeter of the wellhead and the at least one perforated or slotted pipe such that any liquid or gas leaking from the ground can flow through and along the top porous lining or the bottom porous lining or both to the at least one perforated or slotted pipe.

17. The wellhead leak detection and collection system as claimed in claim 16, wherein the porous linings comprise a spun fabric such as a spun geo-fabric, or a woven fabric, or a knitted fabric.

18. The wellhead leak detection and collection system as claimed in claim 17, wherein the flexible cover is wide enough to enclose an area adjacent to the wellhead such that any engineer designed surface backfill puts pressure on the flexible cover to keep the flexible cover in place relative to the wellhead.

19. The wellhead leak detection and collection system as claimed in claim 18, wherein the flexible cover is a poly-fabric and is placed around an outside perimeter of the wellhead such that adjacent sides of the flexible cover overlap and where the flexible poly-fabric cover overlaps are sealed with a sealant or are welded, and perimeter edges of the flexible cover and the porous linings are folded over into a perimeter drainage channel, the perimeter drainage channel is lined with similar flexible material as the flexible cover, in such a manner that allows any surface fluids draining from the top of the flexible cover to be collected and drained to a perimeter collection sump.

20. The wellhead leak detection and collection system as claimed in claim 19, wherein on the top of the flexible cover, a similar porous lining is installed, with a woven porous top cover to minimise soil contamination of an outer porous layer, on top of the porous lining a back fill of crushed gravel, or concrete or engineer designed backfill is laid to protect the flexible cover from UV sunlight deterioration and to allow vehicle traffic over the flexible cover for work and maintenance of the wellhead.

21. The wellhead leak detection and collection system as claimed in claim 20, further comprising an additional gas seal bar installed around and onto a membrane covered side wall of the outer perimeter drainage channel using an adjustable screw clamp, for use when soil conditions or porosity of the soil require an additional gas seal bar.

22. The wellhead leak detection and collection system as claimed in claim 1, further comprising a bund surrounding the perimeter of the collection trench and configured to prevent surface water from outside of the well site from entering the collection trench.

23. A well site comprising:

a wellhead;

a wellhead conductive pipe; and a wellhead leak detection and collection system, the wellhead leak detection and collection system comprising:

at least one perforated or slotted pipe placed adjacent the wellhead and having holes sized to allow the transmission of liquid and gas into the at least one perforated or slotted pipe, wherein the liquid and gas are leaking from the wellhead conductive pipe or the wellhead;

a flexible cover, covering at least one or more areas adjacent and around the wellhead and the at least one perforated or slotted pipe; and a fluid collection trench formed around an outside perimeter of the well site, wherein an outer perimeter of the flexible cover is located within the collection trench.

* * * * *